US008961205B2

(12) United States Patent
Sandwith

(10) Patent No.: US 8,961,205 B2
(45) Date of Patent: Feb. 24, 2015

(54) ELECTRICAL CONNECTORS

(71) Applicant: Electrical Equipment Corporation, Chicago, IL (US)

(72) Inventor: Graeme Sandwith, Chicago, IL (US)

(73) Assignee: Electrical Equipment Corporation, Chicago, IL (US)

( * ) Notice: Subject to any disclaimer, the term of this patent is extended or adjusted under 35 U.S.C. 154(b) by 99 days.

(21) Appl. No.: 13/842,395

(22) Filed: Mar. 15, 2013

(65) Prior Publication Data

US 2014/0273586 A1 Sep. 18, 2014

(51) Int. Cl.
*H01R 13/52* (2006.01)
*H01R 13/53* (2006.01)
*H01R 101/00* (2006.01)

(52) U.S. Cl.
CPC ..... *H01R 13/53* (2013.01); *H01R 2101/00* (2013.01)
USPC ..... 439/149; 439/282; 439/745

(58) Field of Classification Search
USPC ..... 439/149, 282, 367, 744, 745, 564
See application file for complete search history.

(56) References Cited

U.S. PATENT DOCUMENTS

| | | | | | |
|---|---|---|---|---|---|
| 2,907,973 | A | * | 10/1959 | Stevens, Jr. | 439/282 |
| 3,109,690 | A | | 11/1963 | Stevens, Jr. | |
| 3,130,478 | A | | 4/1964 | Stevens, Jr. | |
| 3,226,667 | A | * | 12/1965 | Senior, Jr. | 439/282 |
| 3,297,975 | A | * | 1/1967 | Pope | 439/282 |
| 3,617,987 | A | * | 11/1971 | Sankey | 439/184 |
| 3,644,869 | A | | 2/1972 | Newman | |
| 3,662,296 | A | | 5/1972 | Newman | |
| 4,666,227 | A | * | 5/1987 | Galizia et al. | 439/252 |
| 4,886,471 | A | * | 12/1989 | Fleshman, Jr. | 439/587 |
| 5,433,622 | A | * | 7/1995 | Galambos | 439/282 |
| 5,470,248 | A | * | 11/1995 | Wood | 439/281 |
| 5,542,856 | A | * | 8/1996 | Wood | 439/281 |
| 5,766,030 | A | * | 6/1998 | Suzuki | 439/282 |
| 5,885,113 | A | * | 3/1999 | Bricaud | 439/733.1 |
| 5,934,945 | A | * | 8/1999 | Petersen et al. | 439/744 |
| 6,007,378 | A | * | 12/1999 | Oeth | 439/588 |
| 6,299,491 | B1 | * | 10/2001 | Bruce | 439/745 |
| 6,336,821 | B1 | * | 1/2002 | Hattori | 439/282 |
| 6,475,037 | B1 | * | 11/2002 | Harting et al. | 439/745 |
| 6,764,351 | B2 | * | 7/2004 | Finzer et al. | 439/752 |
| 6,957,988 | B2 | * | 10/2005 | Kieninger et al. | 439/744 |
| 7,112,080 | B2 | * | 9/2006 | Nicholson | 439/283 |

(Continued)

OTHER PUBLICATIONS

RigPower MCC-1 Series Catalog, RigPower, LLC, available at http://www.rigpower.com/images/stories/catalog_MCC-1.pdf (last visited Mar. 22, 2013) (not dated).

RigPower RMP II Series Catalog, RigPower, LLC, available at http://www.rigpower.com/images/stories/rmp_ii_catalog.pdf (last visited Mar. 22, 2013) (not dated).

(Continued)

*Primary Examiner* — Gary Paumen
(74) *Attorney, Agent, or Firm* — Beem Patent Law Firm

(57) ABSTRACT

An electrical connector system including contacts configured to electrically couple to cables at one end and to one another at the other end. Contacts may be housed in rubberized insulations, which in turn may be housed in various types of receptacles, e.g., bulkhead mounts, wall mounts, in line connectors, or caps. Male contact may be disposed within opening of female contact, but insulation surrounding male contact may be configured to envelope insulation surrounding female contact. As a result, an overall diameter of insulations and contacts may be reduced significantly, permitting the use of receptacles sized to accommodate openings previously reserved for metal-on-metal insulating connection systems.

38 Claims, 25 Drawing Sheets

(56) References Cited

U.S. PATENT DOCUMENTS

| | | | | |
|---|---|---|---|---|
| 7,347,741 | B1 * | 3/2008 | Yeomans et al. | 439/744 |
| 7,442,096 | B1 | 10/2008 | Gilliam | |
| 7,497,721 | B2 * | 3/2009 | Lauermann et al. | 439/441 |
| 7,726,998 | B2 * | 6/2010 | Siebens | 439/299 |
| 7,771,221 | B1 * | 8/2010 | Blackwell | 439/282 |
| 7,972,154 | B2 * | 7/2011 | Pech et al. | 439/173 |
| 8,062,045 | B2 * | 11/2011 | Montena | 439/282 |
| 2001/0034146 | A1 * | 10/2001 | Bungo et al. | 439/125 |
| 2005/0042903 | A1 * | 2/2005 | Nicholson | 439/201 |
| 2013/0337670 | A1 * | 12/2013 | Montena et al. | 439/149 |

OTHER PUBLICATIONS

Rhino-Hide 49 Series Connectors and Receptacles Brochure Leviton Manufacturing Co., Inc., available at http://www.leviton.com/OA_HTML/ibcGetAttachmentjsp?cItemId=MGL1ZFDiXqoz53q.9ipJYg&label=IBE&appName=IBE&minisite=10251 (last visited Mar. 22, 2013) (2009).

Roughneck E1049 Series Single-Conductor Connectors Catalog, Cooper Interconnect, Inc., available at http://www.cooperindustries.com/content/dam/public/wiringdevices/interconnect/Resources/Literature/CIRoughneck.pdf (last visited Mar. 22, 2013) (2012).

* cited by examiner

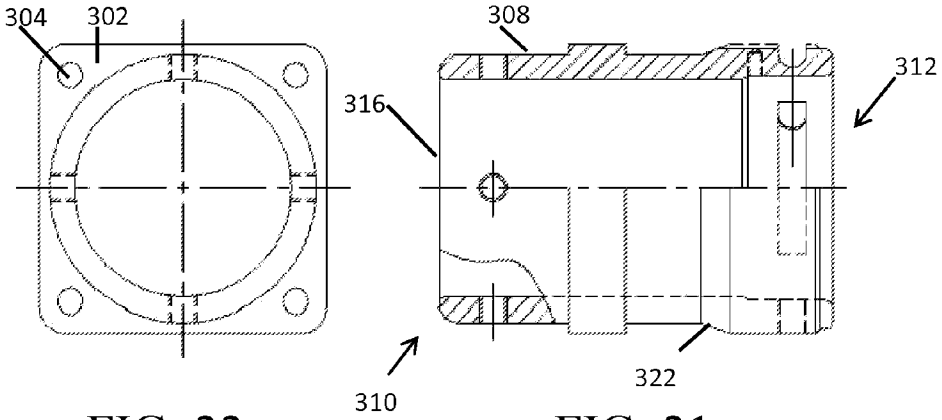
FIG. 22
FIG. 21
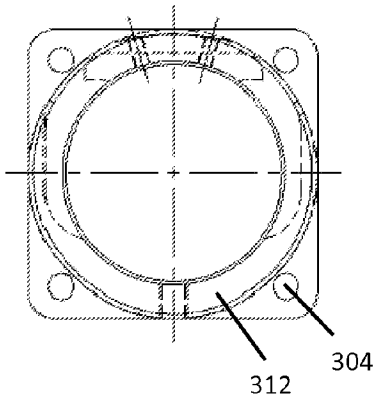
FIG. 23
FIG. 28
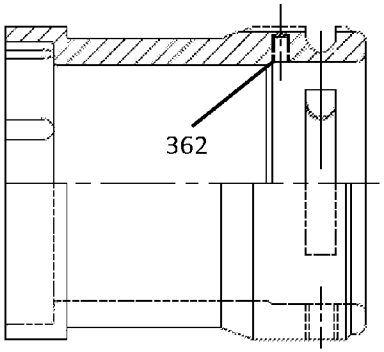
FIG. 27
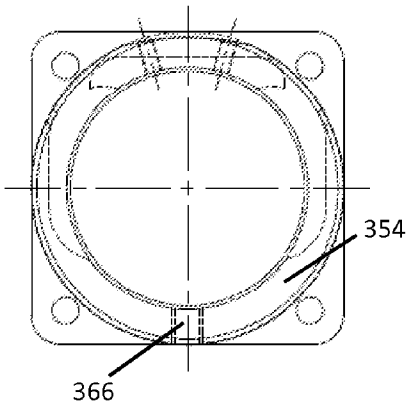
FIG. 29

ELECTRICAL CONNECTORS

BACKGROUND

1. Field of the Invention

This invention relates to a system of electrical contacts, rubber insulators, and receptacles, e.g., for use with mounting to previously-existing structures designed for metal connections between components.

2. Background of the Invention

As control systems become more complicated, more electrical connection systems are required for the control and monitoring of all aspects of the drilling rig. In a rugged oil field environment it is perceived that a high quality rubber connector can be withstand a more abusive environment and is a better insulator than an equivalent metal connector.

At the same time, as the numbers of necessary connector rise, the 'real estate' of the connector panel becomes more valuable. The reduction of connector foot print has been desired for many years. While rubber connectors have the perceived advantages described above, the foot print of the existing art single pin rubber power connector is significantly larger than the equivalent existing art single pin metal power connector.

What is needed is a connector system that overcomes the drawbacks described above.

SUMMARY OF THE INVENTION

As described herein, the following system permits a rubber single pin rubber power connector to be mounted on the same foot print as the existing art single pin metal power connector In one aspect, an electrical connector system may include a contact having a first end configured to electrically couple to a cable and a second end configured to electrically couple to another contact; and a rubber insulation configured to completely surround at least the second end of the contact. The contact may be a male contact, such that the insulation is spaced radially from a perimeter of the second end a distance sufficient to accommodate a female contact and an insulation surrounding the female contact radially inwardly of the insulation surrounding the male contact. The second end may be spaced axially inward from a connector end of the insulation, creating a "dead front end" for the contact.

In addition, the contact may include a plurality of wings extending radially outward when progressing toward the first end. The wings may begin their radial extension at a first radial distance, such that a female contact configured to electrically couple to the male contact includes a second plurality of wings beginning a radial extension at a second radial distance that is different than the second radial distance, thereby preventing the user from inadvertently matching the wrong contact with the wrong insulation. The wings may be disposed on a clip extending circumferentially about at least a portion of the contact, and male and female contacts may use different sized clips. Additionally, an operative portion of the insulation axially aligned with the wings may have an internal opening, the internal opening having a radius smaller than a largest radial extent of the wings, helping to secure the contact inside the insulation.

The insulation also may include an internal opening including a plurality of circumferentially arranged depressions, e.g., about twelve depressions, and the contact may include a plurality of radially outwardly extending protrusions, such that the protrusions may be configured to engage within the depressions.

The electrical connector system also may include a female contact having a first end configured to electrically couple to a cable and a second end configured to electrically couple to the male contact and a second insulation configured to completely surround at least the second end of the female contact. An external diameter of the second insulation proximate the second end of the female contact may be smaller than an internal diameter of the insulation proximate the second end of the male contact.

In another aspect, an electrical connector system may include a contact having a first end configured to electrically couple to a cable and a second end configured to electrically couple to another contact and a rubber insulation configured to completely surround at least the second end of the contact. Here, the contact may be a female contact, and the insulation may circumferentially abut a perimeter of the second end. The second end may be spaced axially inward from a connector end of the insulation, and the insulation may include an interior opening including a substantially axially-extending portion transitioning into a tapered wall portion, wherein the tapered wall portion forms a shoulder against which the second end of the contact is disposed. The system also may include a male contact having a first end configured to electrically couple to a cable and a second end configured to electrically couple to the female contact, and a second insulation configured to completely surround at least the second end of the male contact, the second end of the female contact, and an end of the insulation surrounding the female contact.

In yet another aspect, a receptacle for securing an end of at least one electrical contact and insulation may include comprising an entrance into an interior opening at one end of the receptacle and a sidewall surrounding the interior opening. The sidewall may have a cross-section generally equal to an outer cross-section of a rubber insulation surrounding a male contact, and both the male and female contacts are rated at at least 1000V. While the insulation may be rubber, the receptacle may be metallic.

The receptacle may include a flange spaced from an end of the receptacle, the flange including a plurality of openings configured to receive a plurality of fasteners. Openings may be spaced about 2½" apart, which is about the spacing for prior metal connectors, which connectors could not accommodate rubber insulations.

In one instance, the flange is disposed between the end and a second end of the receptacle. In another, the flange is disposed at a second end of the receptacle. In still another, the flange includes a recess configured to receive a shoulder of an insulation. The recess may include a plurality of indentations circumferentially spaced about the recess, the indentations offset from the plurality of openings by about 22½ degrees.

The receptacle also may include a locking mechanism proximate the one end. Locking mechanism may be manually engageable and releasable. Alternatively, locking mechanism may require a tool for engagement and disengagement.

In still another aspect, an electrical connector system may include a contact having a cable end and a contact end, an insulation completely surrounding the contact end, and a receptacle configured to completely surround the insulation and contact proximate the contact end. If the contact is a male contact, the insulation is spaced radially from a perimeter of the contact end a distance sufficient to accommodate a female contact and an insulation surrounding the female contact radially inwardly of the insulation surrounding the male contact. Conversely, if the contact is a female contact, the insulation circumferentially abuts a perimeter of the contact end. The system also may include a second contact and a second insulation, where one of the contact and the second contact is a male contact and the other is a female contact.

In one instance, the receptacle may be configured to couple to a bulkhead. In another, the receptacle may be configured to mount to a wall. In still another, the receptacle may be configured to allow relocation of the contact and the insulation after coupling with the receptacle.

In a further aspect, a rubber insulation for an electrical connector system may include a cable end having an opening configured to receive a contact having a tip. The insulation also may include a contact end having a second opening and an entrance to the second opening, and an internal channel extending between the opening and second opening, such that the insulation is configured to position the tip axially internally of the entrance. The insulation also may include retention means for keeping at least one of a contact and a receptacle in a predetermined position relative to the insulation. If the contact is a male contact, the contact end is configured to provide a radial gap between the tip and an inner wall of the insulation sufficient to receive a female contact and an insulation surrounding the female contact. Conversely, if the contact is a female contact, the contact end is configured to provide no radial gap between the tip and an inner wall of the insulation.

Retention means may include a plurality of indentations formed circumferentially within an intermediate portion of the internal channel, the indentations configured to interface with a plurality of protrusions extending radially outwardly from a contact. They also may include a diameter of the internal channel configured to press fit against a retention clip disposed around a contact. Additionally, retention means may include a friction fit with intermediate portion spaced between cable end and contact end. Retention means also may include an exterior channel configured to receive one or more set screws operatively coupled to a receptacle. They further may include one or more nipples extending outward from a flange, the nipples configured to be disposed circumferentially around a receptacle.

These and other features and advantages are evident from the following description of the present invention, with reference to the accompanying drawings.

BRIEF DESCRIPTION OF THE DRAWINGS

FIG. 21 is a side, partial section view of the receptacle of FIG. 20.

FIG. 22 is a rear view of the receptacle of FIG. 20.

FIG. 23 is a front view of the receptacle of FIG. 20.

FIG. 27 is a side, partial section view of the receptacle of FIG. 26.

FIG. 28 is a rear view of the receptacle of FIG. 26.

FIG. 29 is a front view of the receptacle of FIG. 26.

DETAILED DESCRIPTION OF THE INVENTION

The electrical connector system detailed herein overcomes the drawbacks described above and other drawbacks of conventional systems by providing a rubberized, insulated connection system that is configured to work with existing systems that previously were configured to receive contacts clad in metal-based components.

Figure 1:
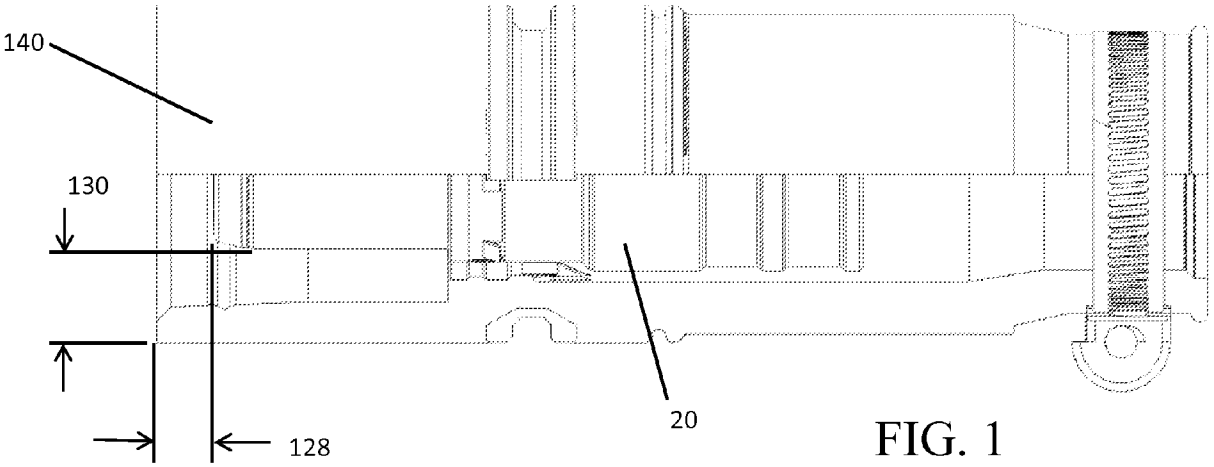
FIG. 1 is a side, partial section view of a male contact and its insulation for use in an electrical connector system.
Figure 2:
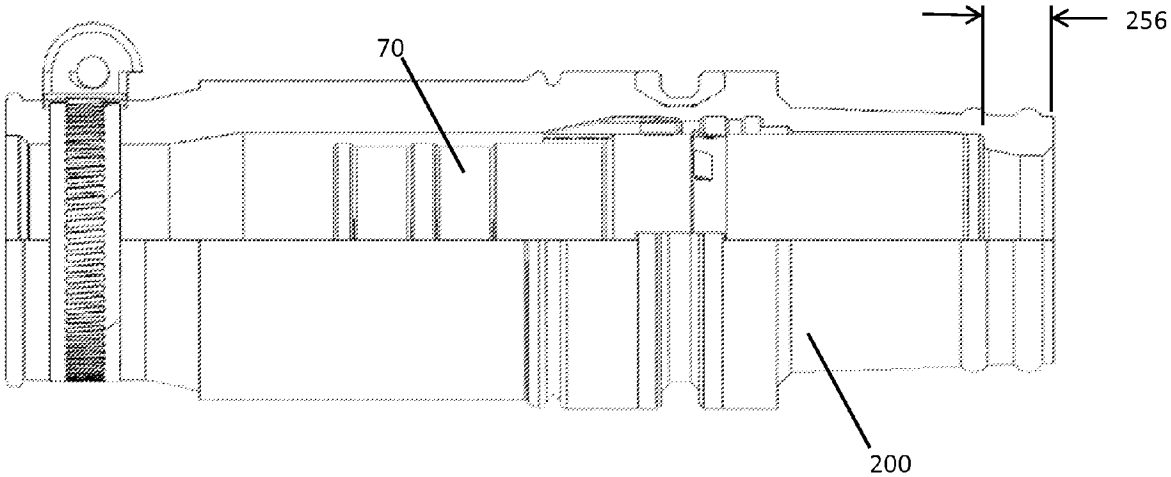
FIG. 2 is a side, partial section view of a female contact and its insulation for use in an electrical connector system

As shown generally in FIGS. 1-2, an electrical connector system may include a male contact disposed within an insulation configured to electrically couple and uncouple with a female contact disposed within an insulation at the respective contact ends of the contacts. Each contact also may be configured to couple to a cable at an end opposite the contact end.

Each contact may be disposed at least partially within an insulation, preferably an electrically non-conductive insulation, and still more preferably a rubberized insulation. Contacts may be retained within insulation in one or more ways including, e.g., a friction fit between a portion of the contact and a portion of the insulation. Additionally or alternatively, a retention clip may be configured to surround at least a portion of a respective contact, and each insulation may be configured to receive a respective retention clip. In one embodiment, retention clips couplable to male and female contacts may be substantially similar to one another so as to be interchangeable. Preferably, however, retention clip configured to couple to male contact may be configured differently, i.e., size and/or shaped differently, from clip configured to couple to female contact.

Electrical connector system also may include one or more receptacles configured to hold at least one of the insulations. Preferably, each receptacle is configured to releasably lock connectors in place after a connection has been made.

Contacts

Figure 3:
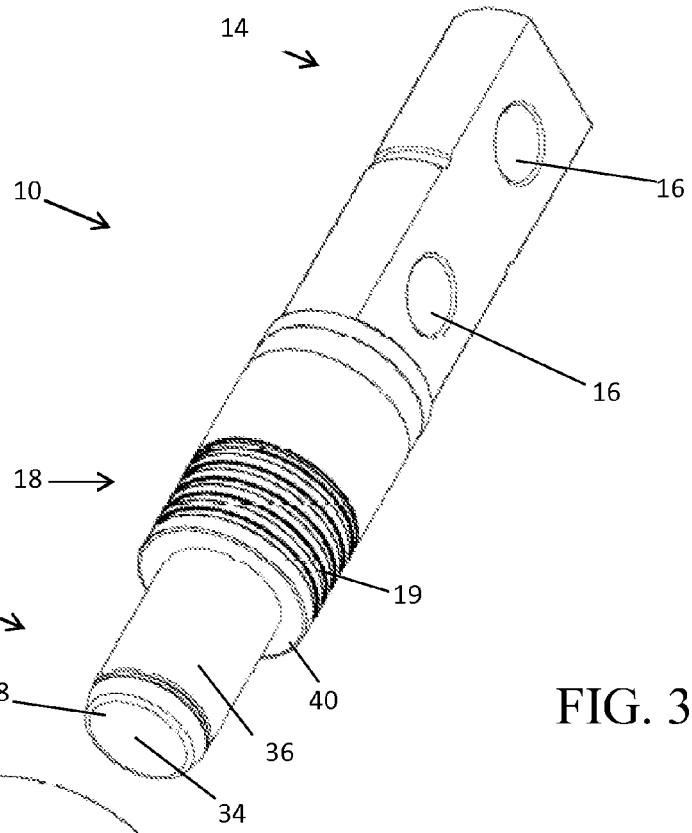
FIG. 3 is a perspective view of a male busbar-type contact.

Turning to FIG. 3, a first male contact 10 is shown. Contact 10 may include a contact end 12 and a cable end 14. Male contact 10 is a busbar-type contact, i.e., a contact that is configured to be located in a substantially unchanging, fixed location, such as operatively coupled to and protruding from a panel mounted to a bulkhead or extending through a wall. In this type of contact, cable end 14 may include a plurality of openings 16, such that contact is configured to receive a plurality of fasteners in order to retain a busbar in electrical contact with cable end 14.

Figure 5:
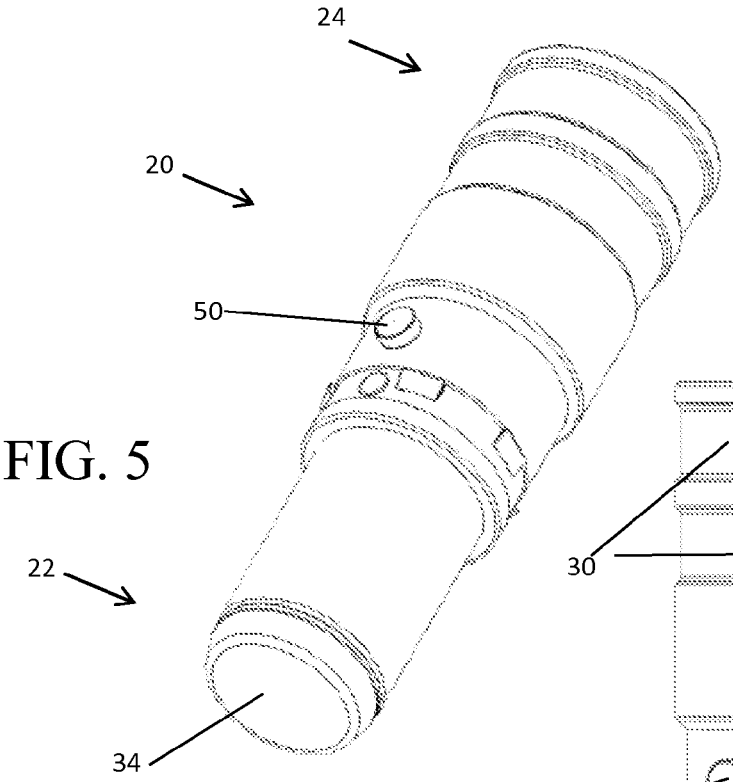
FIG. 5 is a perspective view of the contact of FIG. 4.
Figure 4:
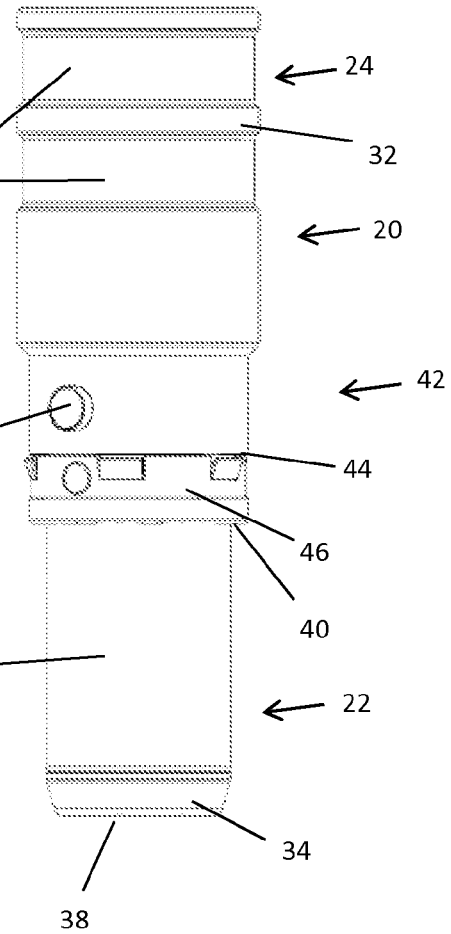
FIG. 4 is a top view of a male crimp-type contact.
Figure 6:
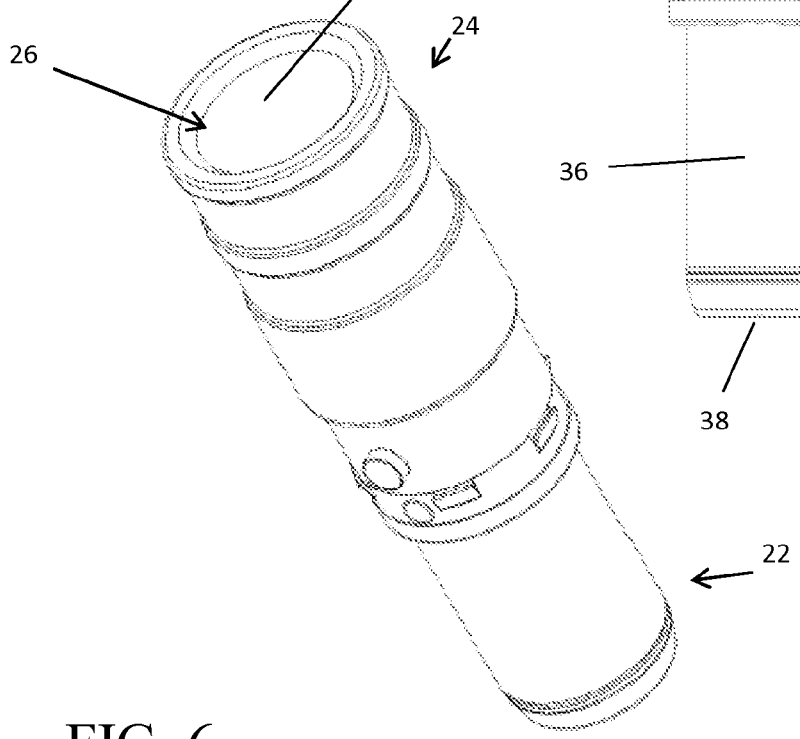
FIG. 6 is a reverse perspective view of the contact of FIG. 4.

Conversely, FIGS. 4-5 illustrate a second male contact 20. Male contact 20 may be a crimp-style contact, having a contact end 22 and a cable end 24. In this style of contact, cable end 24 includes an opening 26 configured to receive a cable.

Cables for use with system may come in various gauges, e.g., 4/0 AWG, 313 MCM, 444 MCM, 535 MCM, 646 MCM, or 777 MCM. Preferably, each style of cable contact remains substantially the same at contact end, regardless of the size of cable used. Busbar-type male contact 10 also may remain substantially the same at cable end 14, regardless of cable size, since it is configured to couple to a busbar and not directly to a cable. Conversely, however, crimp-style male contact 20 may be customized at cable end 24 in order to receive cable of a predetermined size. Specifically, clearance may vary depending upon cable size. For example, a larger cable such as a 777 MCM cable may experience an interference fit, causing insulation to stretch, wherein a 4/0 cable may see a radial gap of up to about ¼" between cable and opening inner wall 28, which may be sealed by closing a hose clamp. In addition, a thickness of wall surrounding opening in cable end 24 may vary slightly depending upon the cable size with which contact 20 is configured to be used, although, in one embodiment, wall thickness may be between about ¼" and about ⅜", including tolerance variations of +/− about 1/64".

In crimp-style male contact 20, cable end 24 also may include one or more grooves 30 with one or more lands 32 there between, such that the grooves are configured to receive one or more clamps or other crimpers. To couple cable to contact, clamps may be placed within grooves 30 around exterior perimeter of contact, proximate cable end 24. Cable then may be inserted generally fully down a length of opening. Clamps may be tightened, deforming cable end and eliminating gap between cable and inner wall of contact.

Contact ends 12, 22 of each style of male contact 10, 20 may be substantially similar to one another. As such, the following contact end description may apply equally to each type of male contact.

Contact end may include a nub 34 at the end with a generally cylindrical portion 36 extending rearward from the nub. Generally cylindrical portion 36 may have a diameter substantially the same size, e.g., within ordinary manufacturing tolerances, as an inner diameter of a receiving portion 82 of a female contact (described below). In one example, generally cylindrical portion 36 may have a diameter of about between about 1 3/64" and about 1 1/16". Nub 34 may be substantially axially aligned along contact. In one embodiment, nub may have a diameter about half that of generally cylindrical portion. Preferably, however, nub may have a diameter substantially equal to that of generally cylindrical portion and then taper or round inward to tip 38 of contact end 12, 22.

Contact end 12, 22 further may include a shoulder 40 at a rearward end of generally cylindrical portion 36. Shoulder 40 may be spaced from a tip 38 of nub 34 greater distance than a depth of an opening in contact end of a respective female contact (described below), such that nub may be configured to contact inner wall of female contact when contacts are electrically or operatively coupled.

Between contact end and cable end, each contact may include an intermediate portion 18, 42. Intermediate portion 18 of male busbar contact 10 may include a series of knurled surfaces 19 along at least a portion of its length, e.g., proximate shoulder 40.

Conversely, intermediate portion 42 of male crimp-style contact 20 may not include knurling, although it may include a groove 44 configured to receive a retention clip 46 (described below). Center of groove 44 may be spaced rearward from shoulder 40 about ¼". Groove 44 may include at least one, and preferably a plurality of openings configured to receive a plurality of fasteners 48 in order to hold retention clip 46 in place.

Intermediate portion 42 also may include at least one, and preferably a plurality, of protrusions 50 extending radially outward from the surface of intermediate portion. In one embodiment, protrusions 50 may be formed integral with intermediate portion. In another embodiment, intermediate portion may include a plurality of openings configured to receive shanks of a plurality of fasteners, and protrusions may be formed by shanks and/or heads of fasteners. Protrusions may serve to assist in forming a snug fit when contact 20 is inserted into insulation (described below)

Contact ends 12, 22 of busbar-type contact 10 and crimp-style contact 20 may have substantially the same diameter and length as one another. In contrast, intermediate portion 18 of busbar-type contact may have an intermediate portion with a diameter larger than diameter of intermediate portion 42 of crimp-style contact, resulting in a larger shoulder, as best seen by comparing FIGS. 3 and 5.

In either case, intermediate portion is configured to press-fit within an interior of its respective insulation.

Figure 7:
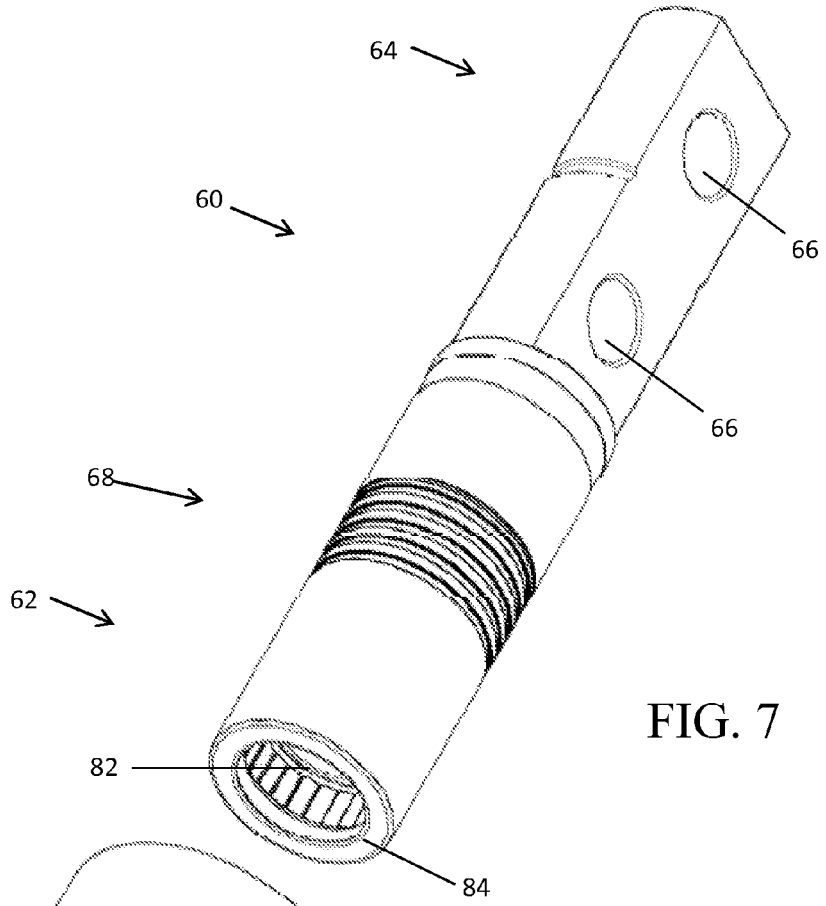
FIG. 7 is a perspective view of a female busbar-type contact.
Figure 9:
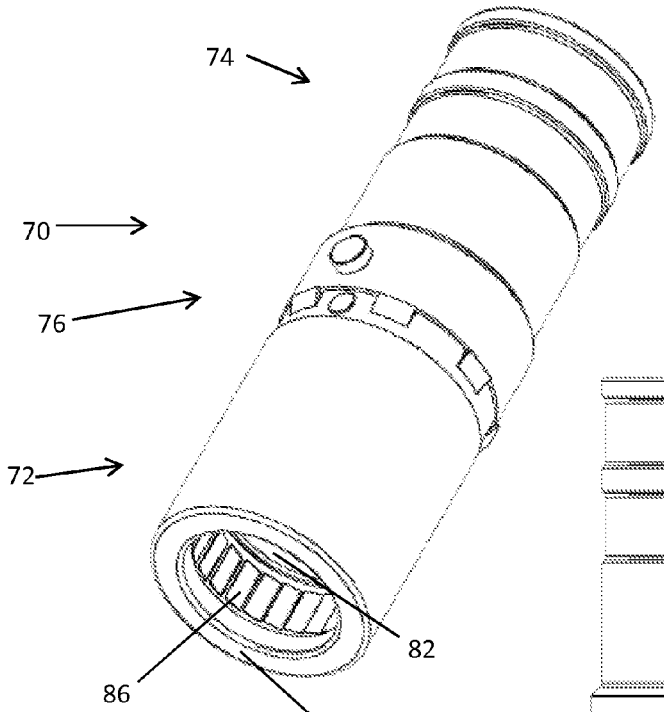
FIG. 9 is a perspective view of the contact of FIG. 4.
Figure 8:
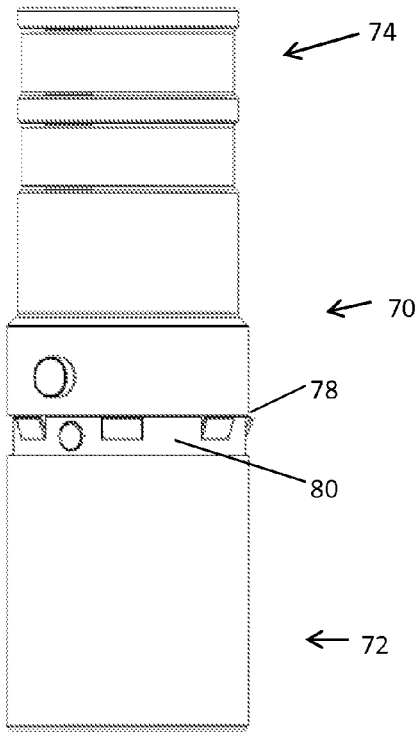
FIG. 8 is a top view of a female crimp-type contact.
Figure 10:
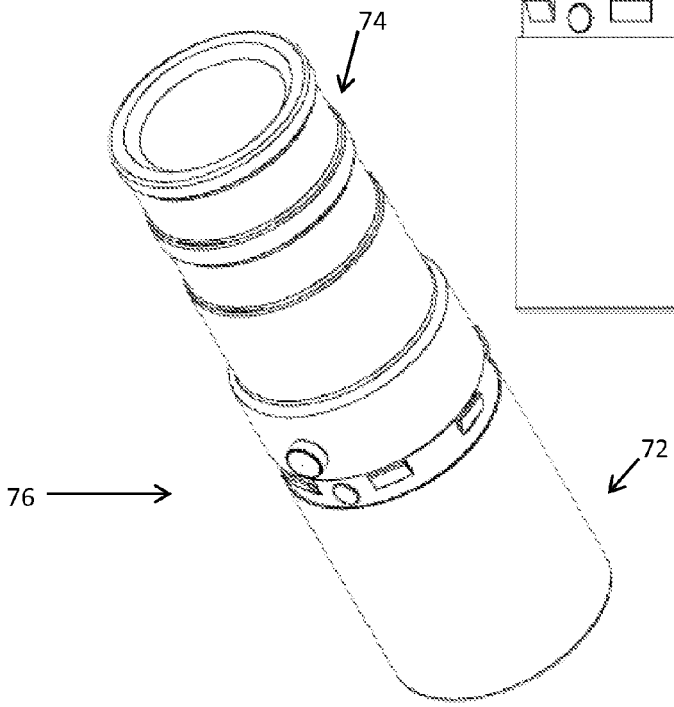
FIG. 10 is a reverse perspective view of the contact of FIG. 4.

Turning now to FIGS. 7-10, complementary female contacts are shown, with FIG. 7 illustrating a female busbar-type contact 60 and FIGS. 8-10 illustrating a female crimp-type contact 70. Each female contact includes a contact ends 62, 72 and a cable end 64, 74. As seen in these figures, cable ends 64, 74 of each of these female contacts may be substantially identical to cable ends 14, 24 of their respective male contacts, e.g., female busbar-type contact 60 may include openings 66 configured to receive fasteners to secure busbar to contact. In addition, intermediate portion 68 of female busbar-type contact 60 from knurling 69 rearward to cable end 64 may be substantially identical to intermediate portion 18 of male busbar-type contact 10 from knurled portion 19 rearward to cable end 14.

Intermediate portion 76 of female crimp-type contact 70 may appear similar to intermediate portion 42 of male crimp-type contact 20 when comparing FIGS. 3-5 and 8-10, e.g., each may include at least one groove or channel 44, 78 proximate contact end 22, 72 that is configured to receive a retention clip 46, 80. Diameters of grooves in male and female contacts may be significantly different from one another, however, so that retention clips having different diameters may be required for use with male and female contacts. Similarly, diameter of intermediate portion 68 of female contact may be sized differently, e.g., larger, than diameter of intermediate portion 42 of male contact. In one embodiment, diameter of female contact intermediate portion 68 may be about 1½" and diameter of male contact intermediate portion 42 may be about 1¼", such that female contact intermediate portion may be about ¼" larger in diameter than male contact intermediate portion.

Because intermediate portions are configured to be press fit within their respective insulations, in this way, a user may be prevented from placing a contact in a non-matching insulation.

Each female contact 60, 70 may include a receiving portion or internal opening 82 extending rearward from tip 84 of contact ends 62, 72. Opening 82 may have a complementary shape with shape of contact ends 12, 22 of male contacts. Preferably, opening 82 and contact ends are substantially cylindrical to permit engagement of contacts without a need to rotate one contact relative to the other to match shapes, although non-cylindrical shapes are permissible.

Opening 82 also may be sized to form an interference fit or a minimal clearance fit between contact ends of male and female contacts, so as to permit transfer of electricity between contacts. To facilitate electrical coupling, a torsion or leaf spring element 86 such as a Multilam band may be fixedly positioned inside internal opening 82, proximate tip 84 of contact.

Insulations

Turning now to FIGS. 11-19, system may include one or more insulations. Preferably, system includes an insulation for every contact.

In one embodiment, a cable end may be substantially fixed in location, e.g., at a bulkhead or wall installation. In another embodiment, the cable end may be substantially free, e.g., to couple with a substantially fixed cable or to couple with another freely-movable cable. In either instance, the cable end may be coupled to a male or a female contact, e.g., the fixed cable end may couple to a busbar-type contact, and the free cable end may couple to a crimp-type contact.

Figure 11:
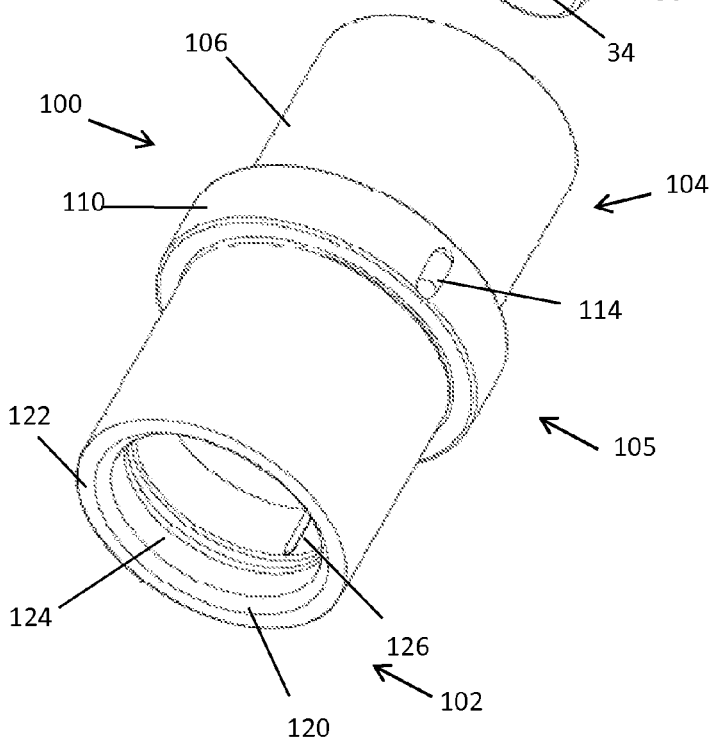
FIG. 11 is a perspective view of an insulation used with a male contact.
Figure 12:
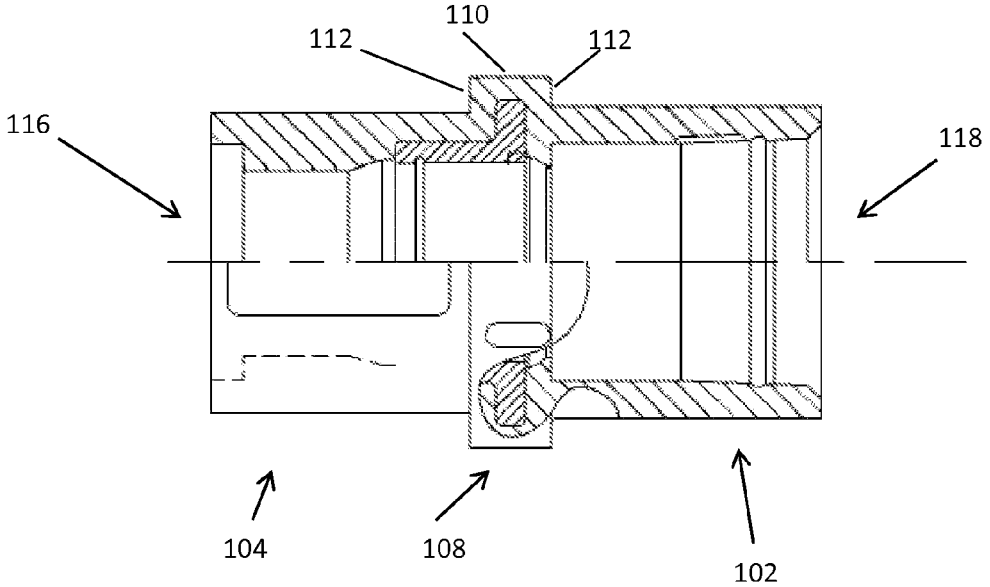
FIG. 12 is a side, partial section view of the insulation of FIG. 11.

FIGS. 11-12 illustrates one example of an insulation 100 configured to receive a male contact, e.g., at a substantially fixed location. Right side of FIG. 12 may be considered a connector or contact end 102, and left side of FIG. 12 may be considered a cable end 104.

Exterior 106 of insulation 100 may include an enlarged cross-sectional area 108, e.g., a rib 110 forming one or more shoulders 112 at a location between cable end and connector end. Radially outwardly extending shoulder 112 on insulation may be configured to abut a radially inward extending shoulder, wall, or groove 370 on a receptacle in order to establish and maintain a lateral position of insulation 100 (and, therefore, contact 10) with respect to receptacle.

In addition, rib 110 may include one or more additional protrusions 114 extending even further radially outward than rib, as best seen in FIG. 11. Additional protrusions 114 may be configured to be disposed within one or more indentations 374 circumferentially spaced around inward extending shoulder or wall of receptacle so as to rotationally fix insulation 100 with respect to receptacle. Receptacle may include at least as many indentations as there are protrusions on insulation. Preferably, receptacle includes a greater number of indentations.

Cable end 104 of insulation may include an inner opening 116 configured to receive cable and a portion of cable end 14 of male contact 10. In one embodiment, this type of insulation may be configured to receive busbar-type contact, such that substantially all of cable end of contact may extend outward beyond cable end of insulation.

Contact end 102 of insulation also may include an inner opening 118 configured to receive contact end 12 of male contact 10.

In addition, contact end 102 of insulation 100 may be configured to receive contact end 72 of female contact 70 and contact end 242 of female insulation 240. Even though contact end 102 of male insulation 100 goes around the outside of female insulation 240, it still is considered a male insulation 100 because it contains the male contact 10.

Inner opening 118 of contact end 102 may include a chamfer 120 at the entrance 122 to the opening. Inner wall 124 of opening then may taper radially outwardly, thinning wall surrounding opening, before turning back and tapering inwardly, thereby thickening wall surrounding opening.

First tapered portion may extend inward from entrance to opening between about ⅜" and about ¾", preferably between about ½" and about ⅝", and in one embodiment, about 9/16". Second tapered portion may extend from an end of first tapered portion to a point between about ¾" and about 1¼" rearward from entrance, preferably between about 1" and about 1⅛" rearward.

Alternatively, wall of inner opening may not taper radially outwardly but may remain generally axial or may include a depression prior to tapering radially inwardly.

Inner wall 124 also may include one or more axial venting grooves 126 (similar grooves 236 may exist on the exterior of a female insulation). Venting grooves 126 may permit air to escape as insulations are mated and unmated, facilitating coupling and decoupling.

When contact is installed as designed within insulation, tip 38 of contact may be spaced rearward from entrance 122 to opening 118, creating an air gap 128 between electrically conducive contact and front end of insulation. For example, an axial distance between a front of insulation and front of contact may be between about ½" and about ¾", and in one embodiment, about ⅔" or about 0.66". Additionally, contact may include a non-conductive cap at its tip forming a "dead front end" of the contact, and an axial distance between a front of insulation and dead front end may be between about ¼" and about ½", preferably between about ⅓" and about ½", and in one embodiment, about 0.41".

There also may be a radial gap 130 between contact end of contact and inner wall of insulation. Gap may be between about ¼" and about ½", preferably about ⅓", and in one embodiment, about 0.39". FIG. 1 illustrates these gaps—although it uses a different male insulation, the air gaps may be substantially the same for both male insulations.

In addition to permitting female contact and insulation to pass between male contact and inner wall of male insulation, gap also may have the advantage of permitting cable system to have a higher voltage rating. For example, whereas previous connector systems having similar sized contacts may be rated at about 1000 V, this system may be rated for about 2000 V.

Figure 13:
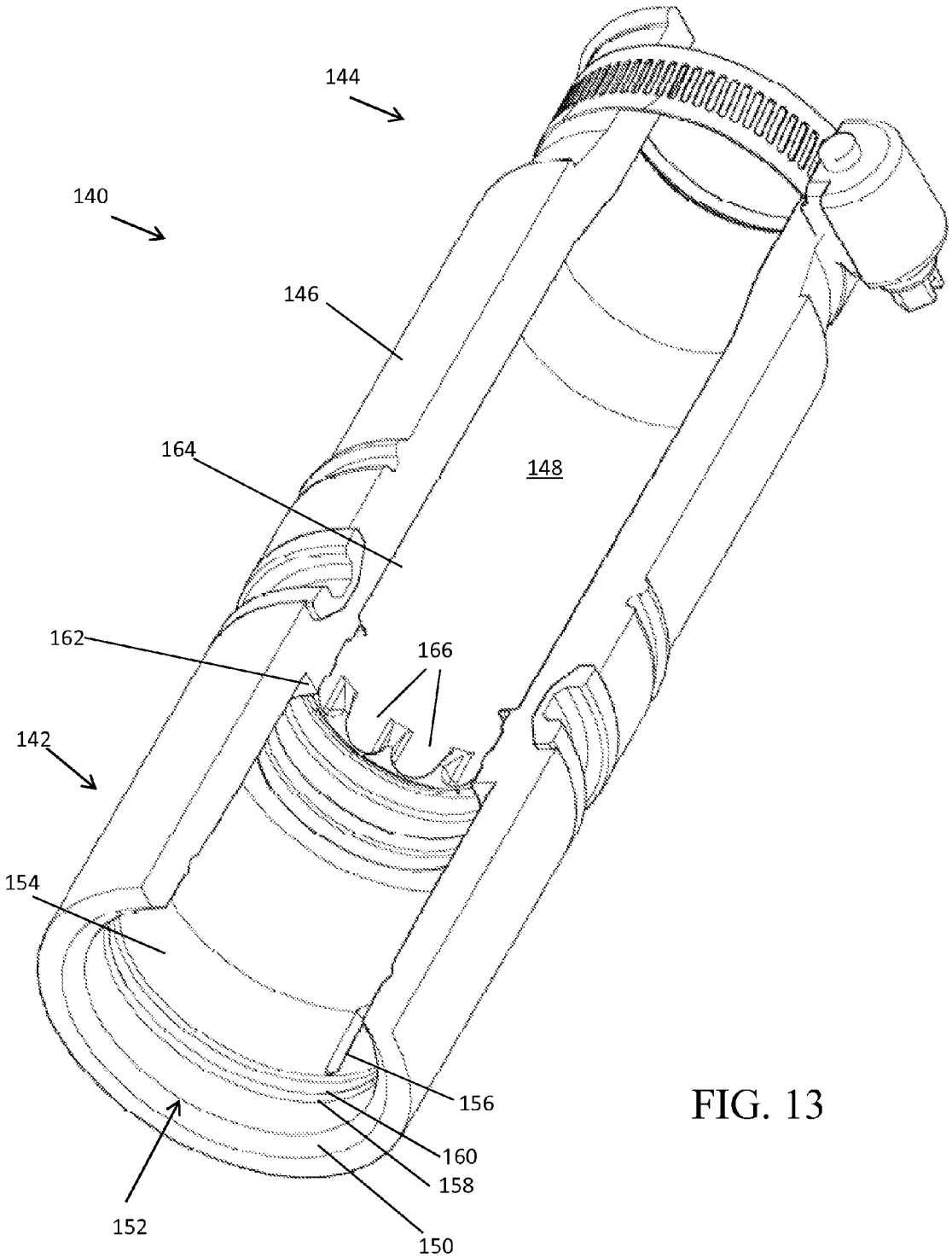
FIG. 13 is a partial cutaway, perspective view of a second insulation used with a male contact.
Figure 14:
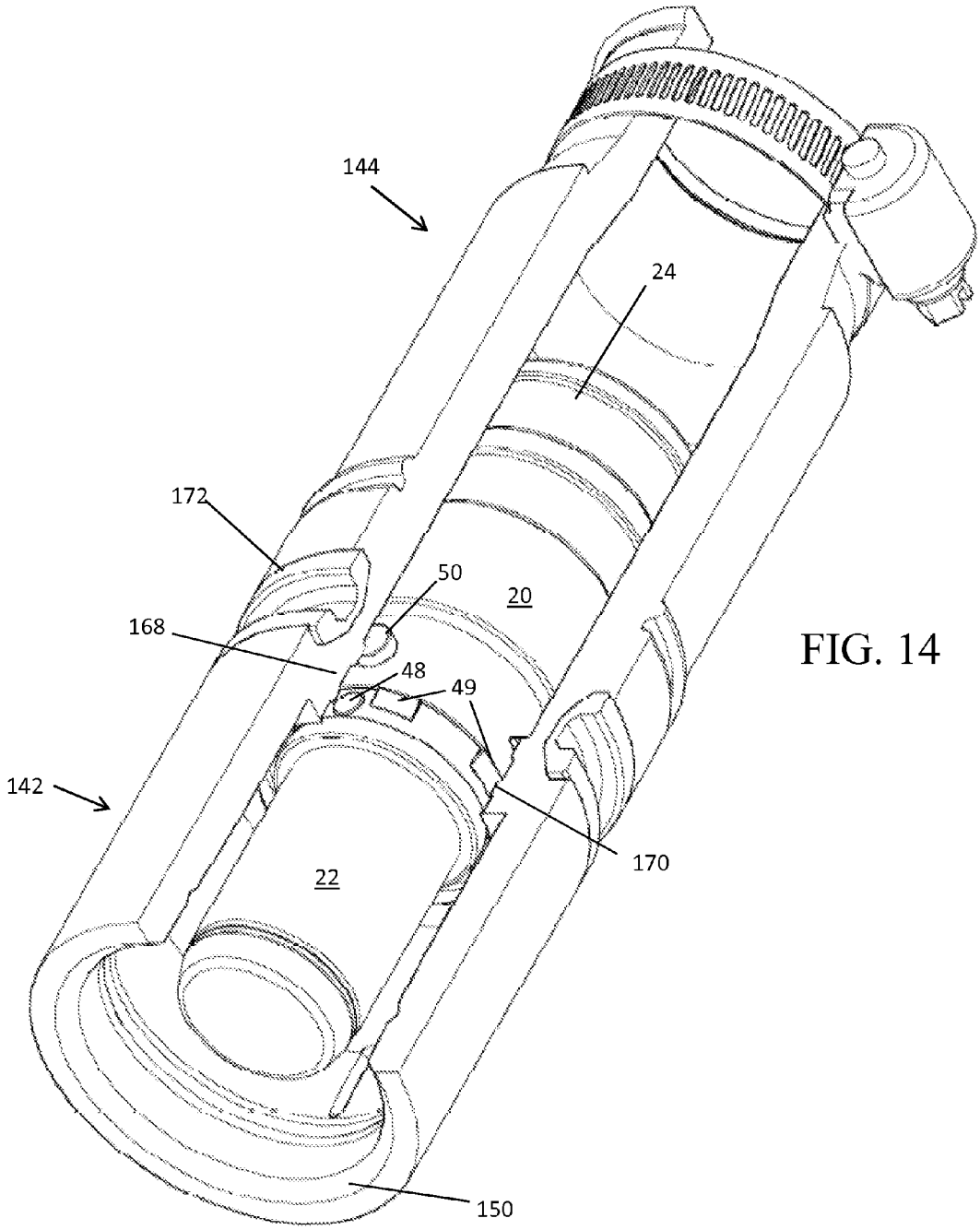
FIG. 14 is a partial cutaway, perspective view of the second insulation of FIG. 13, along with a male contact.

Turning now to FIGS. 13-14, an example of an insulation 140 configured to receive a male contact 20 at a freely movable position is shown. In one embodiment, this type of insulation also may be usable when male contact is in a generally fixed position, e.g., when operably secured to a receptacle passing between walls. Like the male insulation described above, the insulation of this figure may include a contact end 142, a cable end 144, and an exterior 146 and inner channel 148 there between Inner channel 148 may extend the length of the insulation 140. Channel at cable end 144 of insulation may be configured to receive cable end 24 of contact 20 and a portion of cable. Cable end of insulation preferably is configured to extend beyond cable end of contact in order to cover any potential unshielded portion of cable proximate cable end of contact, such that only shielded cable emerges from cable end of insulation.

Similarly, contact end 142 of insulation may be configured to receive contact end 22 of male contact 20, as seen in FIG. 14. Like the other male insulation, the insulation of FIGS. 13-14 may include a chamfered entrance 150 to the opening 152 and a taper 154 from the opening extending inward in which the wall thickness increases along a length of the insulation. Additionally, insulation 140 may include one or more venting grooves 156, preferably axial venting grooves.

Inner opening of insulation also may include a groove 158 and or protrusion 160 extending at least partially circumferentially around opening 152. Groove and/or protrusion may be disposed along tapered portion 154, e.g., at an axial location proximate tip of contact end 142 of contact 140. A female insulation, described below, may include similar complementary ribs 232 and/or indentations 234 around an external surface in order to facilitate holding insulations together once coupled.

Insulation 140 may be configured such that contact end 22 of contact 20 is spaced rearward from contact end of insulation as seen in FIG. 1. Insulation also is configured with a diameter of inner opening proximate contact end such that there is a radial gap between insulation and contact end of contact sufficient to receive contact end of female contact and contact end of female insulation. Axial and radial gap distances for female contact may be substantially similar to those described above for male contacts.

Insulation 140 also may include a ring disposed within inner channel. Ring may be a more rigid material than insulation, e.g., whereas insulation may be a rubber-type material, ring may be a plastic or metal. Inner channel 148 may extend inward from contact tip end to a shoulder 162, where the inner channel translates to a reduced diameter portion 164. Ring may be disposed on reduced diameter portion, proximate shoulder. In one embodiment, ring may be molded inside insulation when insulation is formed. Alternatively, ring may be press fit inside insulation after mold is formed and/or ring may be held in place using an adhesive. Ring also may include one or more rearwardly extending wings that may assist in keeping ring in place during use. Insulation may include channels configured to receive wings, further helping to lock ring in place.

Preferably, however, insulation 140 may not include internal ring but instead may have a plurality of scallops 166 molded into interior channel 148. As seen in FIG. 14, scallops may be sized and axially located so as to engage protrusions 50 on contact. Previous types of insulations included four cutouts in an internal ring, whereas there may be between about 10 and about 16 scallops, preferably about 12 scallops, which may permit contact 20 to be disposed in a significant number of configurations rotationally with respect to insulation.

Interior wall 168 between shoulder 162 and scallops 166 may be configured to receive retention clip 46. Retention clip may include a one or more openings configured to receive fasteners 48 to secure retention clip in place. Retention clip also may include one or more flaps 49 extending radially outwardly when travelling in a rearward direction. When slid forward from cable end of insulation toward contact end, retention clip may slide into opening. Outwardly extending flaps 49 then may press outward against indented portion 170 of interior 168, thereby inhibiting rearward movement of contact relative to insulation, effectively locking contact in place relative to insulation.

Insulation 140 further may include a channel 172 extending inward around an exterior perimeter 146. In one embodiment, the channel 172 may be axially positioned at a location proximate retention clip 46 and protrusions 50. Channel 172 may be formed of or filled with a more rigid material than a remainder of insulation, e.g., a metal or harder plastic and may be configured to receive one or more fasteners, e.g., set screws to hold insulation in place relative to a receptacle.

Figure 15:
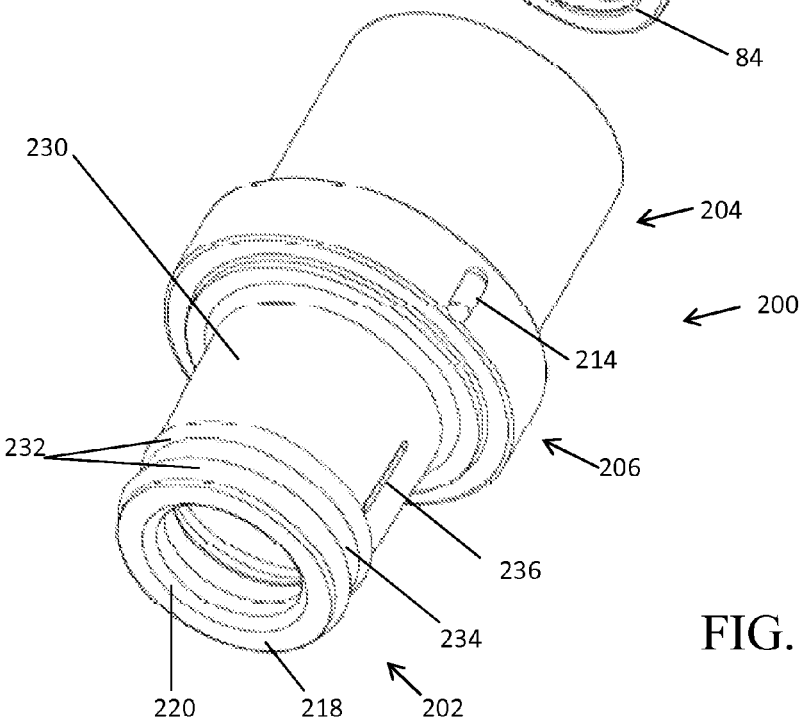
FIG. 15 is a perspective view of an insulation used with a female contact.
Figure 16:
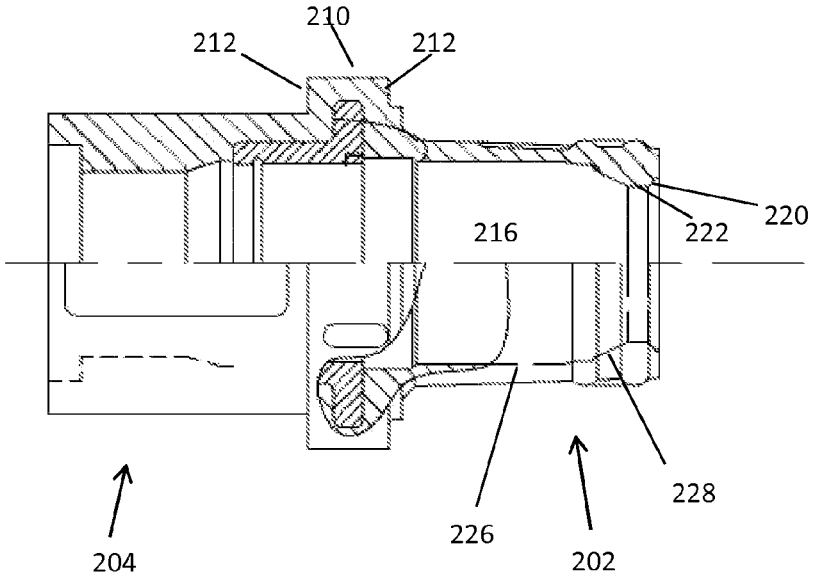
FIG. 16 is a side, partial section view of the insulation of FIG. 15.
Figure 17:
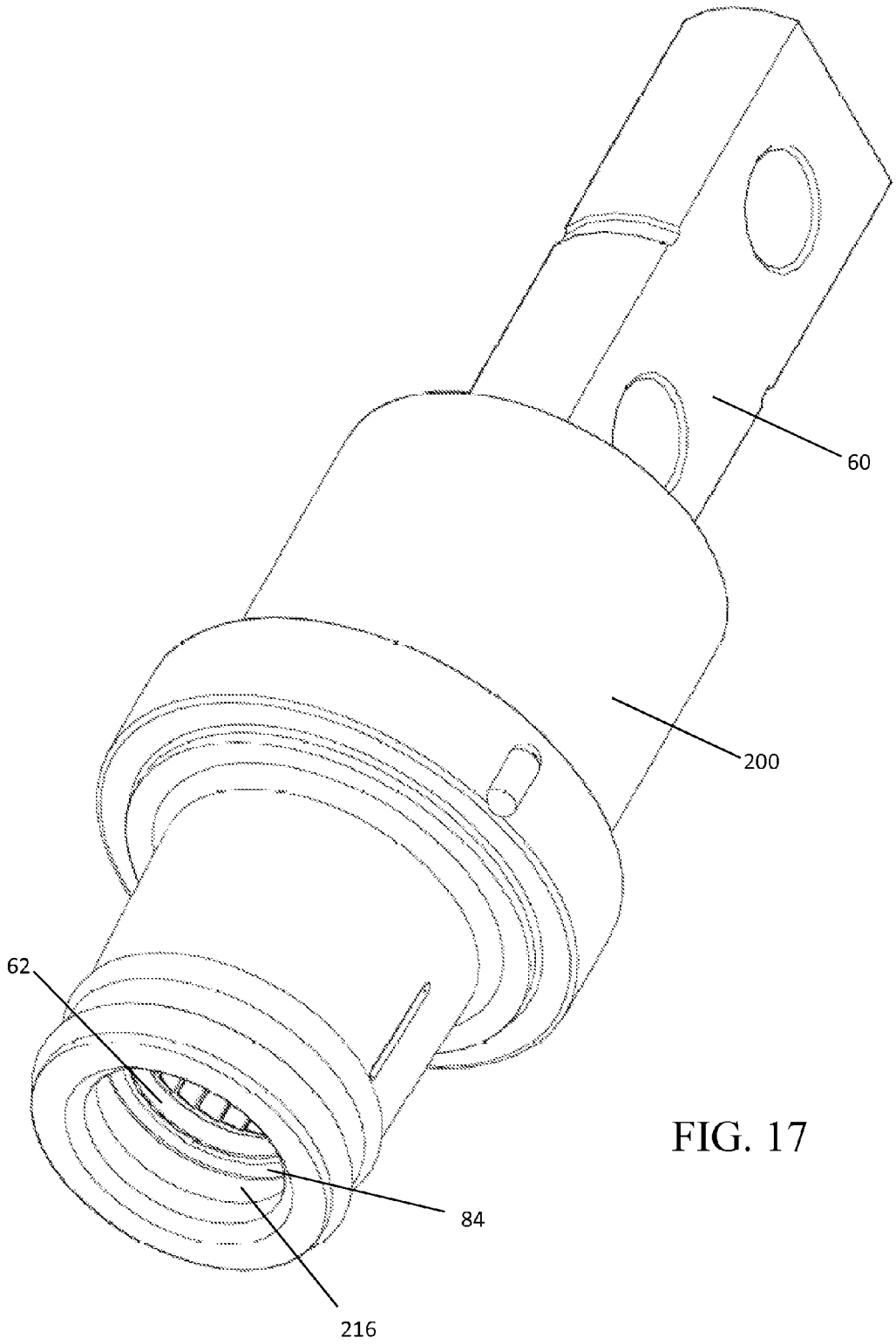
FIG. 17 is perspective view of the insulation of FIG. 15, along with a female contact.

Turning now to FIGS. 15-17, an insulation 200 configured to receive a female contact 60 at a substantially fixed location is shown. Like the other insulations described above, and like the female contacts, this insulation includes a contact end 202 and a cable end 204, with an intermediate portion 206 in between.

Cable end 204 and intermediate portion 206 of this contact may be substantially similar to cable end 104 and intermediate portion 105 of the male insulation 100 shown in FIGS. 11-12. For example, cable end 204 of insulation 200 may be configured to extend axially a shorter distance than cable end 64 of contact 60, thereby allowing busbar portion to be uncovered so as to connect busbar to contact. In addition, intermediate potion 206 may include an outwardly extending rib 210 with shoulders 212 configured to abut a similar shoulder in a receptacle, thereby inhibiting lateral movement of the insulation and contact relative to the receptacle. Similarly, the rub 210 may include one or more protrusions or nipples 214 configured to be disposed within one or more indentations circumferentially spaced around inward extending shoulder or wall of receptacle so as to rotationally fix insulation with respect to receptacle. Receptacle may include at least as many indentations as there are protrusions on insulation. Preferably, receptacle includes a greater number of indentations.

Interior surface 216 of insulation proximate contact end may be configured to receive contact end 62 of female contact 60. Unlike conventional insulations, however, contact end of female contact may be disposed to abut interior surface of insulation, as seen in FIG. 17. Without a gap between contact and insulation, insulation then is configured to be disposed inside male insulation. In this case, insulation still is considered a female insulation because it contains the female contact.

Tip 218 of contact end 202 of insulation may include a radially inwardly disposed chamfer 220, which may assist in guiding male insulation and contact inside insulation. Proceeding rearward from chamfer 220, insulation may include a generally axial portion 222 having an axial length greater than axial length of chamfer, followed by a taper 224 extending back radially outwardly, significantly decreasing wall thickness of contact end of insulation. After taper 224, interior wall of contact portion may match shape of female contact exterior surface, e.g., it may have a substantially constant diameter.

Tapered portion 224 may form a shoulder 228 against which tip 84 of contact end of female insulation may abut. Between radial forces exerted by inner sidewall of insulation and axial forces exerted by tapered portion, female insulation may provide support for female contact, which may allow insulation wall to be thinner between inner opening and exterior surface than a thickness of the wall between inner opening and exterior surface of male insulation. For example, in one embodiment, wall portion surrounding contact end of female insulation may be between about 5/16" and about 3/8" thick, whereas wall portion surrounding contact end of male insulation may be between about 7/16" thick and about 5/8" thick.

Because tip 84 of contact end 62 of female contact 60 is configured to abut tapered portion 224 within female insulation 200, this insulation also is configured such that tip 84 of contact end is recessed axially from tip 218 of insulation, as seen in FIG. 16. In one embodiment, tapered portion may extend from about 1/4" recessed from tip of insulation to about 1/2" recessed, and tip of contact may be disposed at any location along this length.

Exterior surface 230 of insulation 200 at contact end 202 may be configured to releasably couple with interior surface of contact end of male insulation, although insulations may be configured to resist separation, such that clearance between insulations may be minimal or such that a slight interference fit may exist between insulations when coupled. Preferably, exterior surface 20 of insulation may taper in a complementary fashion with taper of interior surface of contact end of male insulation, e.g., between about 1 degree and about 5 degrees, and in one embodiment, about 2 degrees, such that exterior surface expands radially outward when moving rearward from tip of contact end of insulation.

Exterior surface 230 of insulation at contact end also may include one or more friction increasing surfaces to enhance connection with male insulation. Friction increasing surfaces may comprise, e.g., protrusions 232 or indentations 234 configured to interface with respective indentations 158 or protrusions 160 on interior surface of male insulation. Exterior surface 230 also may include venting grooves 236 similar to venting grooves 126 on inner wall 124 of male insulation.

Figure 18:
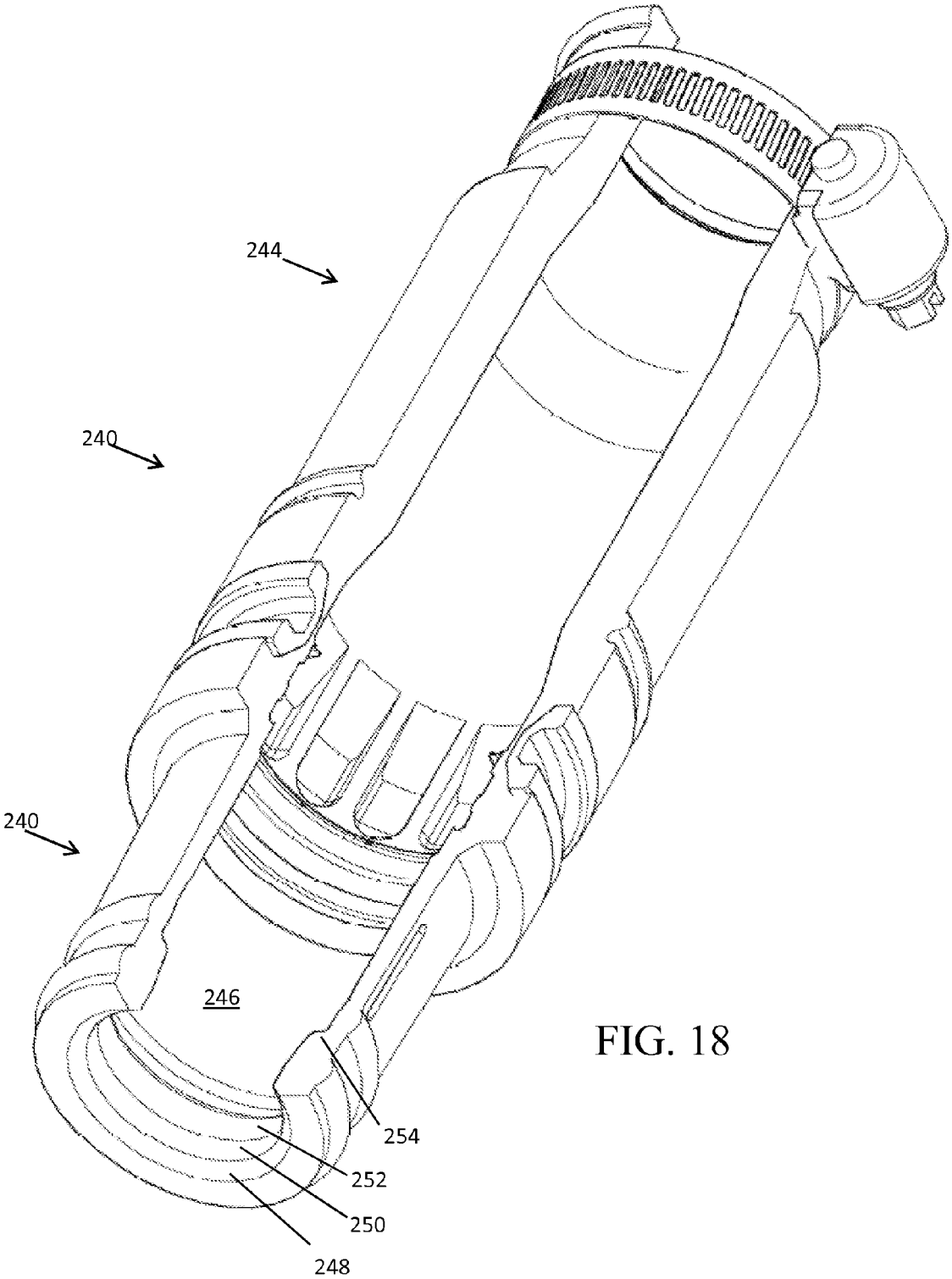
FIG. 18 is a partial cutaway, perspective view of a second insulation used with a female contact.
Figure 19:
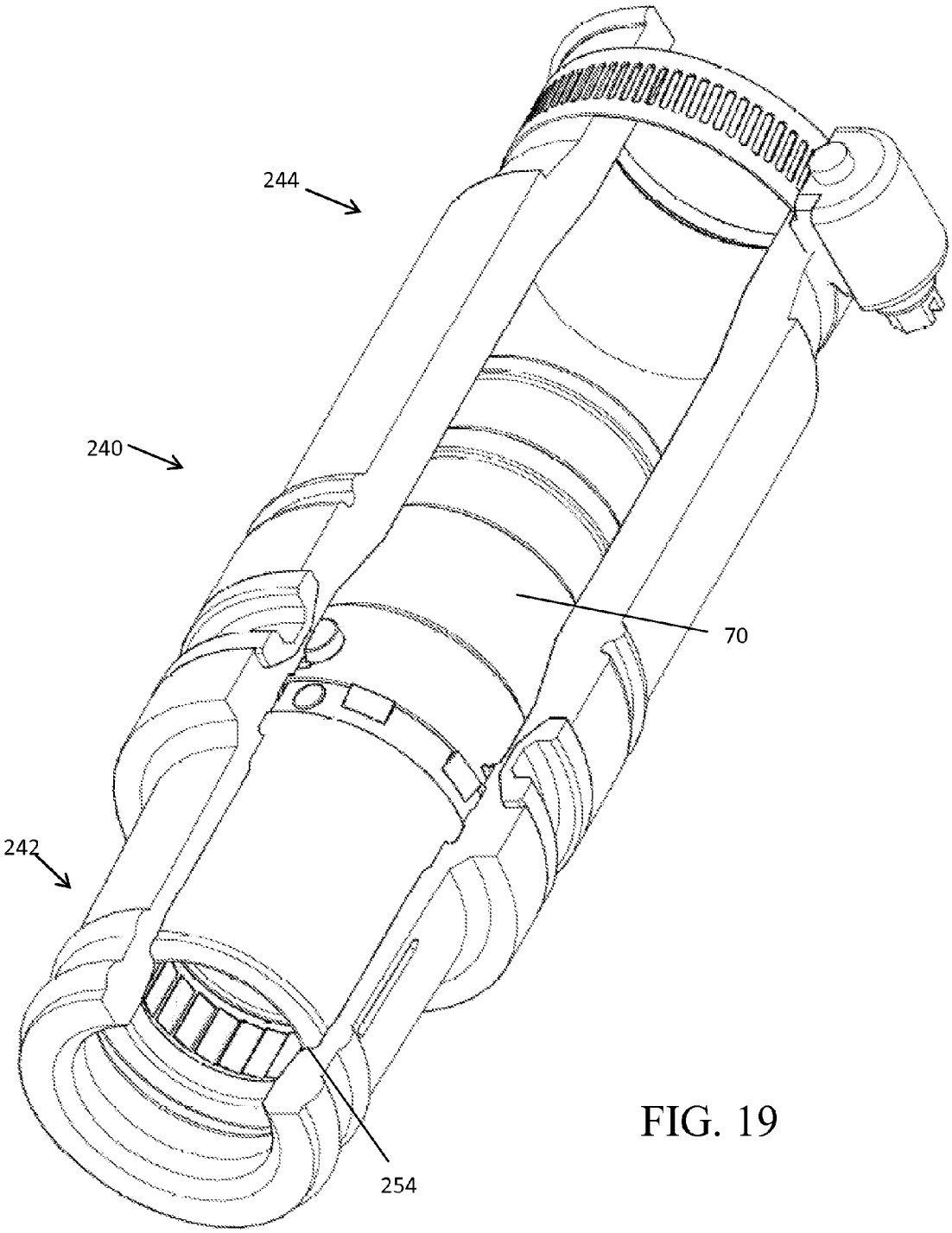
FIG. 19 is a partial cutaway, perspective view of the second insulation of FIG. 18, along with a female contact.
Figure 20:
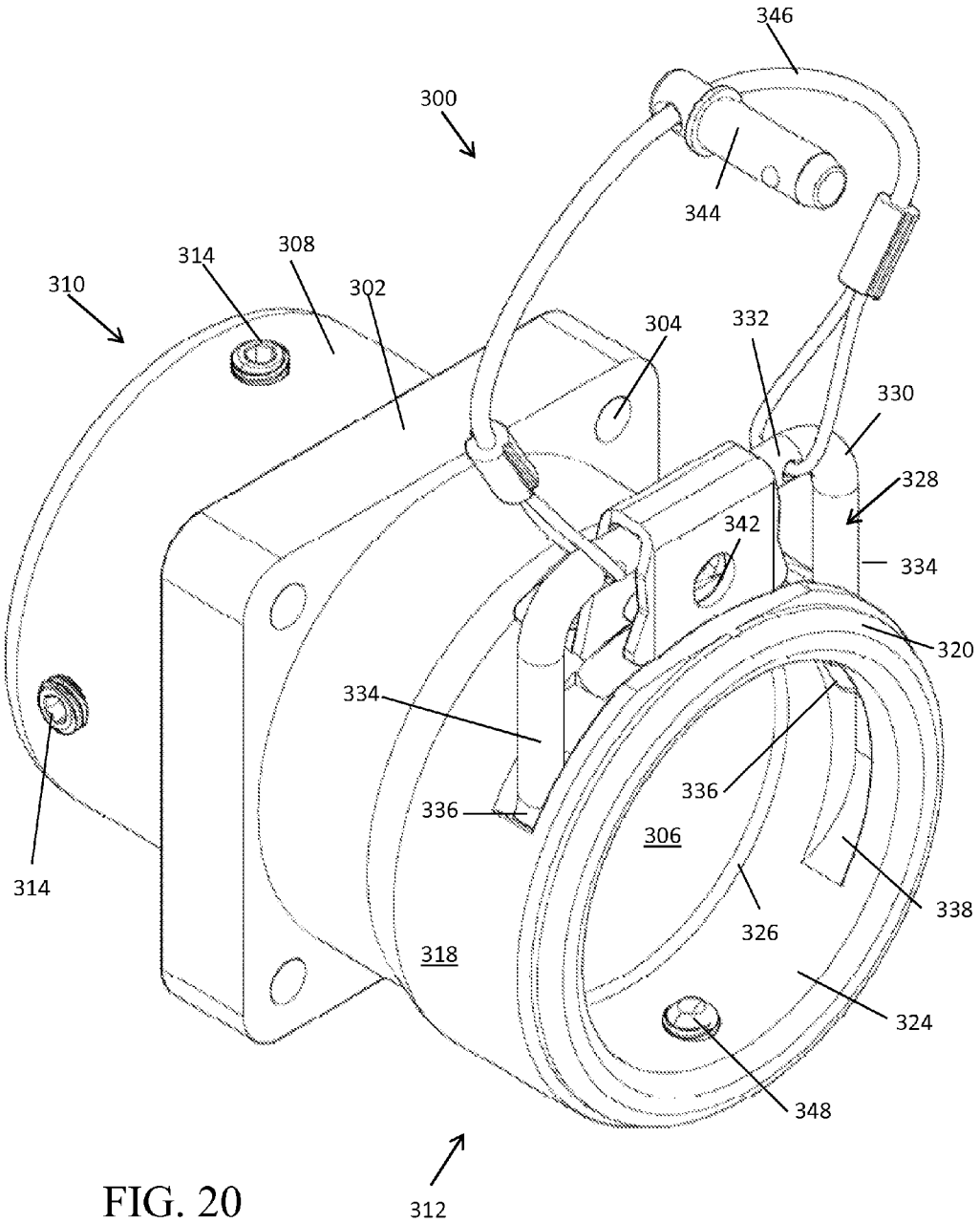
FIG. 20 is a perspective view of a receptacle for securing two contacts and their insulations together.

Turning now to FIGS. 18-19, an example of an insulation 240 configured to receive a female contact 70 at a freely movable position is shown. In one embodiment, this type of insulation also may be usable when female contact is in a generally fixed position, e.g., when operably secured to a receptacle passing between walls. The insulation of FIGS. 18-19 may be a hybrid of the male insulation of FIG. 13 and the female insulation of FIGS. 15-17 in that contact end 242 of insulation may be substantially similar to contact end 202 of female insulation 200, while cable end 244 of insulation 240 may be substantially similar to cable end 144 of male insulation 140.

Like female insulation 200, inner surface 246 of insulation may include a chamfer 248, a substantially flat radial portion 250, and a tapered portion 252. Contact end 242 of insulation 240 may differ from the contact end 202 of female insulation 200, however, in the degree to which tapered portion 252 tapers. For example, tapered portion 224 in insulation 200 may taper at about 25 degrees relative to an axis of insulation, whereas tapered portion 252 in insulation 240 may taper at about 10 degrees. Because this tapered portion 240 tapers to a smaller degree over substantially the same axial extent, inner surface may include a shoulder 254 to restrict lateral movement of contact 70 relative to insulation to a larger degree, which may be beneficial, as this insulation may be subjected to more frequent connections and disconnections and their related axial forces. Like tip of male contact inside male insulation, tip of female contact inside insulation 200 may include an axial air gap 256 between contact end 232 of insulation and tip of female contact.

As discussed above, insulation 240 may be a hybrid of other insulations discussed above. Thus, structurally similar elements in this insulation may correspond to structural elements discussed above with respect to those other insulations.

Receptacles

Turning now to FIGS. 20-43, a series of receptacles configured to receive one or more insulations are shown.

FIGS. 20-23 illustrate a first embodiment of a receptacle 300, which may be affixed within an opening in a bulkhead. Receptacle 300 may include a bulkhead-mounting portion 302, which may be a rectangular or substantially square plate (although other shapes are permissible) including a plurality of openings 304 configured to receive a plurality of fasteners to couple the receptacle to the bulkhead. Openings 304 may be arranged in a square or other evenly distributed pattern, which may permit receptacle 300 to be mounted in a plurality of orientations.

In a preferred embodiment, bulkhead-mounting portion may be substantially square and may have sides measuring just under about 3 1/4". Openings 304 in bulkhead-mounting portion may be substantially equally spaced, e.g., at corners of the portion, and openings may be about or slightly more than 2 1/2" apart along the sides of a square. This distance may be substantially equal to spacing between openings in prior metal-based insulation and receptacle embodiments, although it also may be significantly smaller than spacing between openings in prior rubberized-type insulations, which are not capable of interfacing with those previous metal receptacles.

The receptacle shown in FIGS. 20-23 may be configured to fixedly receive insulations of the types shown in FIGS. 11-12 and 15-16. Receptacle may include an inner opening 306, which may be substantially cylindrical with a generally constant diameter and which may extend along a length of the receptacle. Diameter of inner opening may be between about 2 1/4" and about 2 1/2", and in one embodiment, may be about 2.44". Put another way, diameter of inner opening 306 may be configured to securely receive exterior surface of contact end 102 of male insulation 100. Since contact end 202 of female insulation 200 may be smaller than contact end 102 of male insulation 100, diameter of inner opening 306 may be larger than exterior surface of contact end 202 of female insulation 200.

Exterior 308 of receptacle along cable end 310 may be sized slightly smaller than bulkhead mounting portion 302 in order to permit cable end 310 of receptacle to pass through opening in bulkhead. For example, cable end exterior may be substantially circular in cross-section and may have a diameter of about 3". In this way, receptacle 300 may be configured to install in openings previously designed for metal-metal couplings but while now permitting use of rubberized insulations. With cable end 310 disposed within bulkhead or behind bulkhead wall, contact end 312 may protrude outward from bulkhead wall.

A first, or cable, end 310 of receptacle may be configured to semi-permanently receive an insulation, i.e., while insulation may be operably separable from receptacle, e.g., in order to change out insulation or cable, insulation preferably is held in place while cables coupling to insulation are swapped out. Either a male or female insulation may be retained in this position.

First end 310 may include one or more locking mechanisms 314, e.g., set screws, which may prevent lateral movement of insulation inserted into opening 316 in first end. Although a single set screw may be sufficient to hold insulation in place, receptacle preferably includes a plurality of set screws. In one embodiment, receptacle may include four set screws distributed evenly about a perimeter of first end 310.

Figure 24:
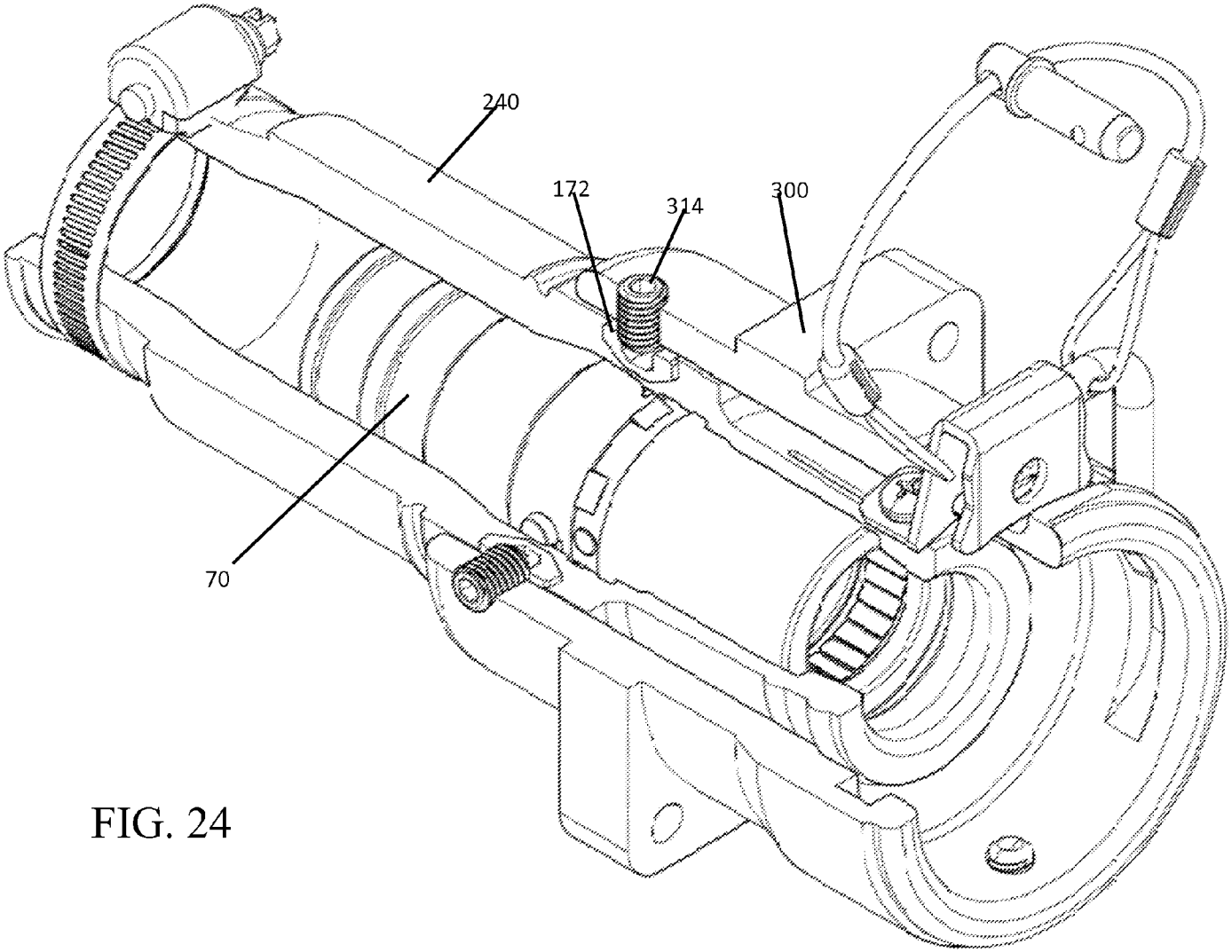
FIG. 24 is a partial cutaway, perspective view of the receptacle of FIG. 20 housing a female contact and its insulation.
Figure 25:
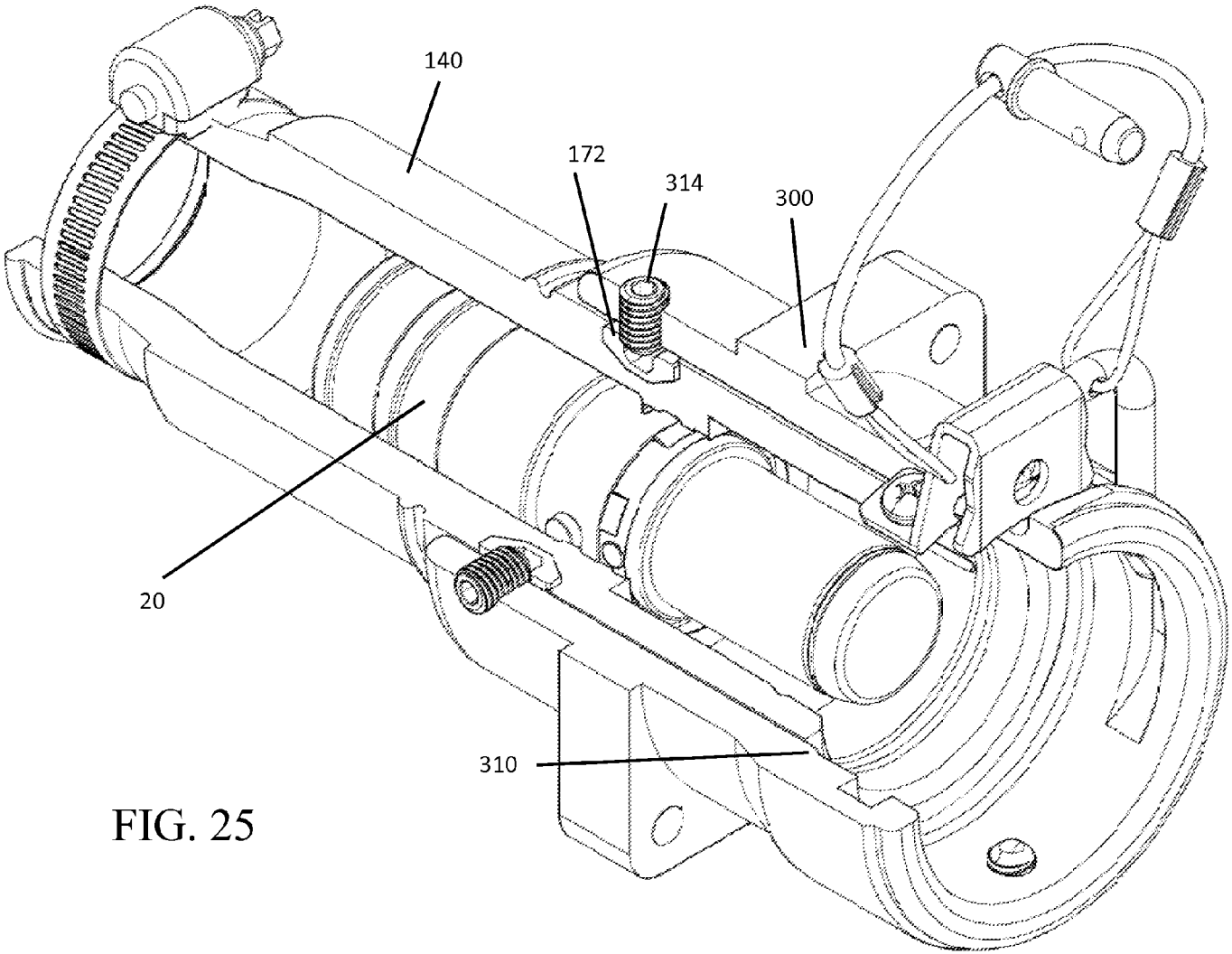
FIG. 25 is a partial cutaway, perspective view of the receptacle of FIG. 20 housing a male contact and its insulation.
Figure 26:
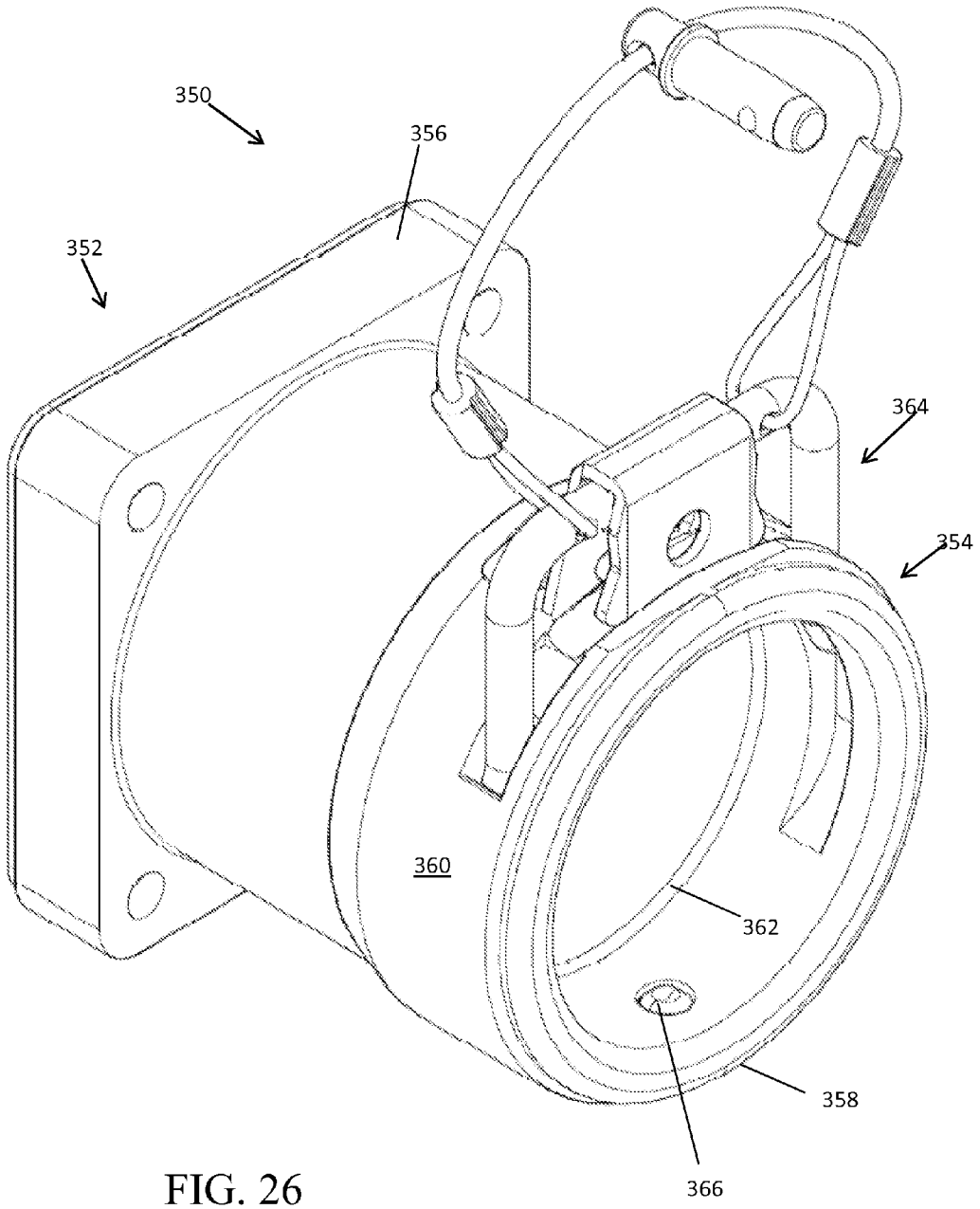
FIG. 26 is a perspective view of a second receptacle for securing two contacts and their insulations together.

As discussed above, insulation may include a channel or ring 172 extending around and radially inward from an outer perimeter. Locking mechanisms 314 may be disposed at an axial position along receptacle so as to overlie channel or ring when insulation is installed properly, as seen in the assemblies of FIGS. 24-25.

Turning now to second, or contact, end 312 of receptacle, exterior of receptacle may include a thickened wall portion 318 surrounding at least a portion of receptacle end. Contact end may have a generally circular cross-section with an external diameter between about 3" and about 3½", and in one embodiment about 3¼". Put another way, external diameter may be about ¼" larger than external diameter proximate cable end, or wall may be about ⅛" thicker in cross-section than cable end wall. Thickened wall portion may extend rearward from proximate tip 320 of contact end 312 between about 1" and about 1½". In one embodiment, thickened wall portion may reduce to a generally constant diameter via a frustoconical taper 322. Taper may be angled between about 15 degrees and about 30 degrees, preferably about 20 degrees, relative to axis of receptacle.

While interior opening 306 of receptacle may have a generally constant cross-section along its length, a portion 324 of interior opening set back from contact end opening until opening may have a slightly larger cross-section. For example, opening may include an increased-diameter portion extending rearward from entrance between about ¾" and about 1", and in one embodiment, about 0.88". Increased-diameter portion may terminate at a shoulder 326, which may be an inclined surface, which may provide a bearing surface or stop against which insulation entering through cable end may bear, helping establish an axial extent to which insulation may travel.

Like cable end 310 of receptacle, contact end 312 may include a locking mechanism 328 to hold an insulation in place during use. Locking mechanism 328, however, may be configured to provide quick, convenient locking and unlocking and removal of cable. As such, locking mechanism may include a manual locking and release capability, so that tools may not be necessary. In one embodiment, locking mechanism may include a hasp 330 configured to move perpendicular to insulation.

Hasp 330 may be positioned on receptacle so as to overlie channel or ring extending around and radially inward from an outer perimeter of insulation inserted in contact end of receptacle. Hasp 330 may be generally U-shaped with a cross-piece 332 and two legs 334 extending generally perpendicular to cross-piece towards ends 336 of hasp. Ends 336 may be angled outward from legs, e.g., between about 20 degrees and about 30 degrees, and in one embodiment, about 27 degrees.

Hasp 330 may extend through exterior surface of receptacle to interior surface through one or more channels 338 in receptacle body. Preferably, hasp 330 is oriented so that translational direction of hasp is parallel to one or more sides of bulkhead mounting portion 302, although hasp also may mounted at an offset angle.

Spacing between ends 330 of hasp may be such that when hasp is in a disengaged configuration, ends are disposed between interior and exterior surfaces of thickened wall portion 318. When hasp is moved into an engaged configuration, a portion of ends may remain disposed between interior and exterior surfaces, although a portion of ends 336—and a portion of legs 334—also may be disposed inward of interior surface.

Hasp may be retained in place via mounting bracket 340 that may be disposed on both axial sides of hasp and further may be disposed above hasp, i.e., hasp 330 may be disposed between receptacle 300 and mounting bracket 340. Mounting bracket may include a locking mechanism 342, e.g., one or more openings configured to receive a pin 344, in order to keep hasp in an engaged configuration once engagement occurs. Opening may be disposed radially outwardly of cross-piece 332 when cross-piece 332 is engaged, such that pin 344 disposed in opening may prevent radially outward movement of hasp 330.

Pin 344 may be secured to a flexible cable 346 that may be fixedly coupled to receptacle 300, e.g., by passing through openings in hasp 330. In addition to keeping pin attached to receptacle, thereby preventing losing pin 344, cable 346 also may serve as a handle with which a user can pull up hasp 330, thereby disengaging locking mechanism 328.

Receptacle may include additional locking mechanisms 346 at contact end 312. For example, receptacle may include one or more set screws configured to be disposed in external channel or ring on insulation, i.e., set screw may be equally longitudinally spaced along receptacle in comparison to hasp.

Figure 30:
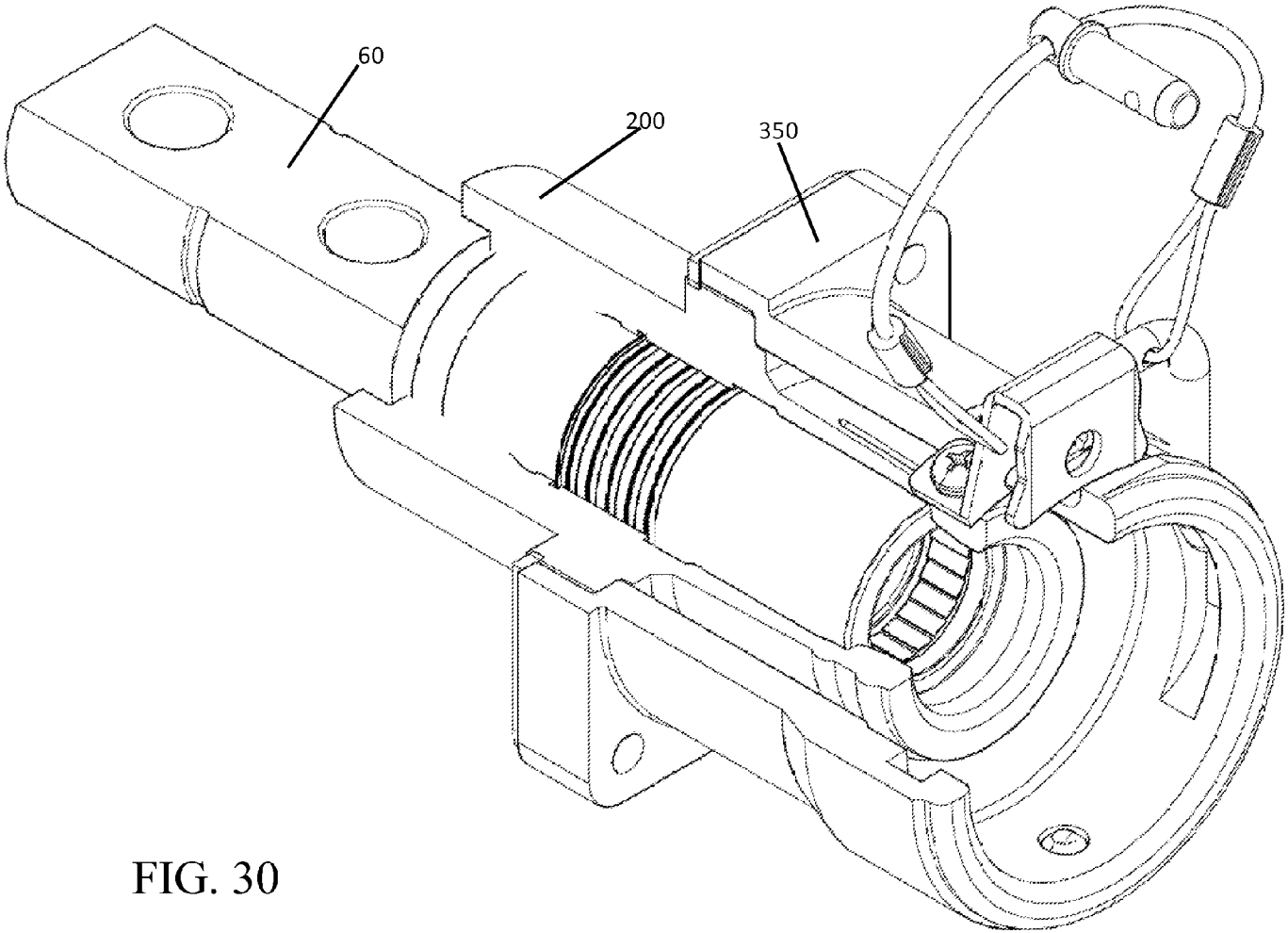
FIG. 30 is a partial cutaway, perspective view of the receptacle of FIG. 26 housing a female contact and its insulation.
Figure 31:
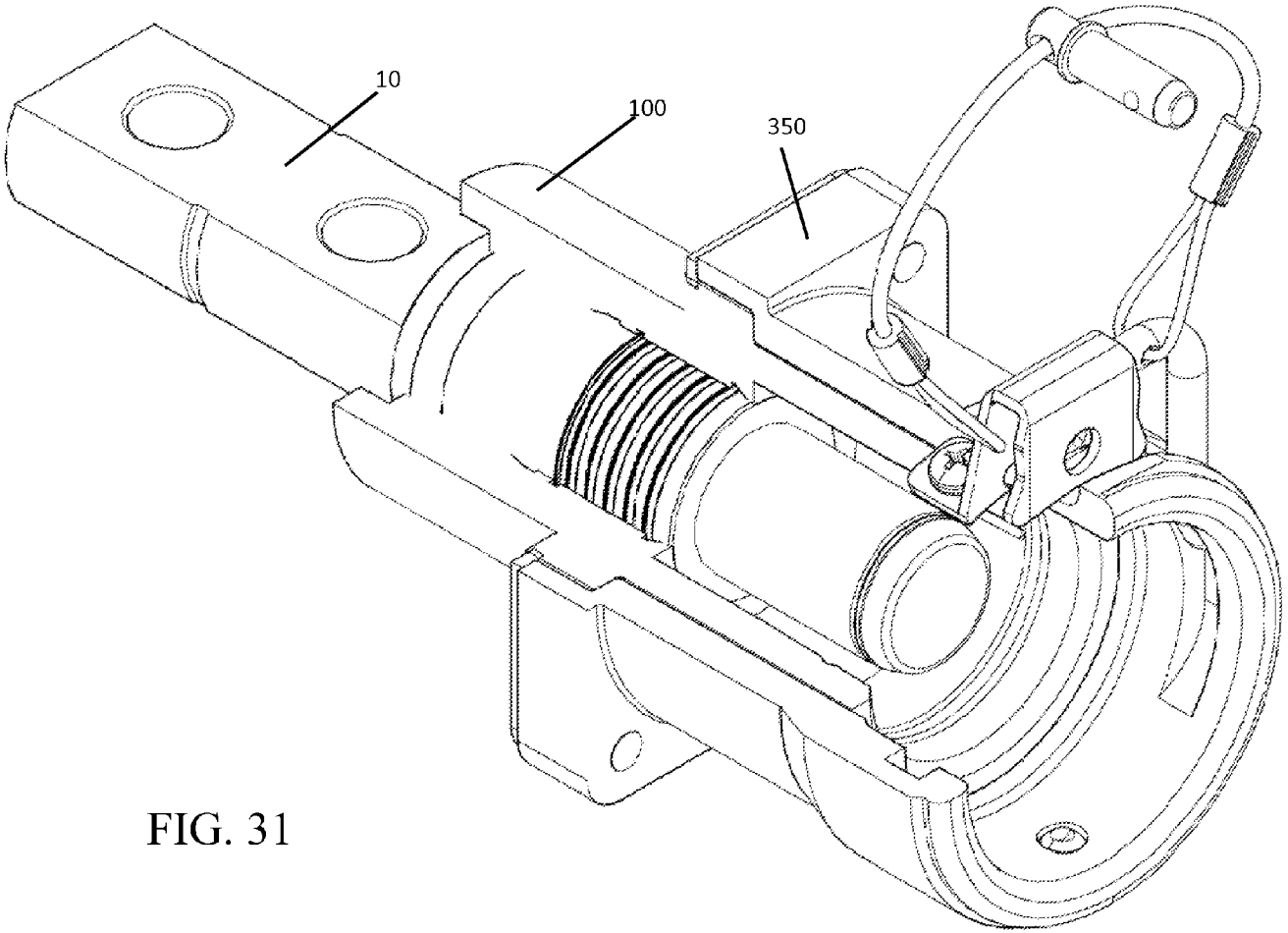
FIG. 31 is a partial cutaway, perspective view of the receptacle of FIG. 26 housing a male contact and its insulation.
Figure 32:
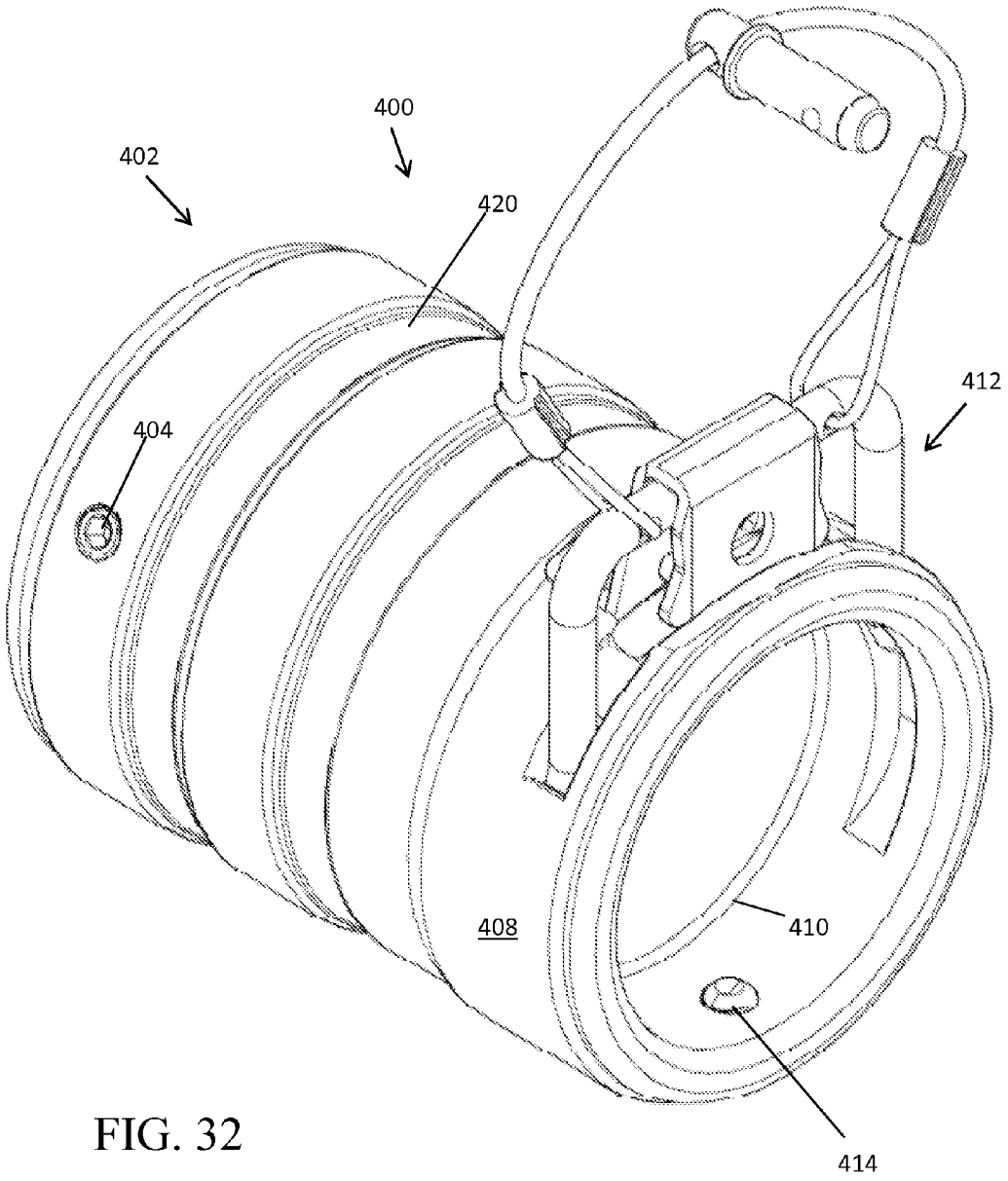
FIG. 32 is a perspective view of a third receptacle for securing two contacts and their insulations together.
Figure 35:
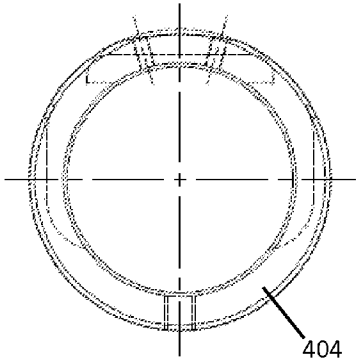
FIG. 35 is a front view of the receptacle of FIG. 32.
Figure 33:
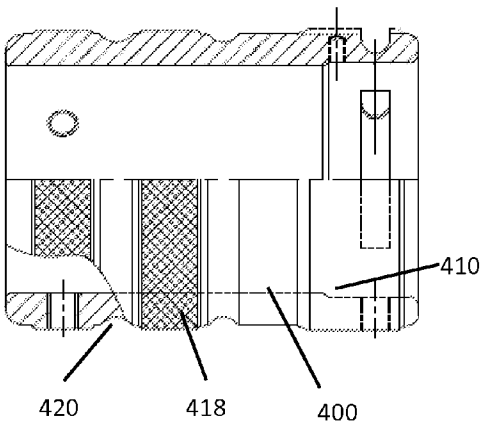
FIG. 33 is a side, partial section view of the receptacle of FIG. 32.
Figure 34:
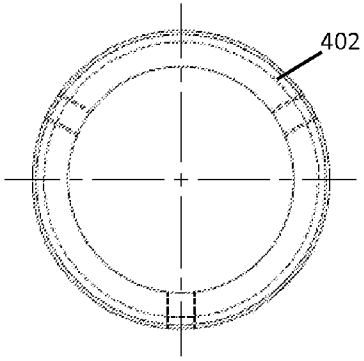
FIG. 34 is a rear view of the receptacle of FIG. 32.
Figure 41:
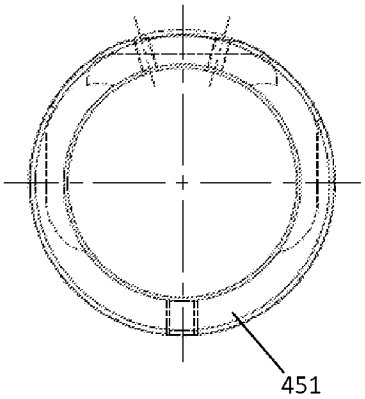
FIG. 41 is a front view of the receptacle of FIG. 38.

Turning now to FIGS. 26-31, another embodiment of a receptacle 350 is shown. Receptacle 350 may be like receptacle 300 in that it may be designed to hold at least one insulation in a substantially fixed position. Receptacle 350 particularly may be well-suited where insulation and contact mounted within receptacle are a busbar-type insulation and contact, as seen in the assemblies of FIGS. 30-31.

Receptacle 350 extends from a first end 352 to a second, or contact end 354. Receptacle 350 may resemble portions of receptacle 300 from mounting portion 356 toward tip of 358 contact end 354, including increased wall portion 360, inner shoulder 362, and locking mechanisms 364, 366. Instead of cable portion extending rearward from bulkhead mounting portion, however, mounting portion 356 may be the first end 352 configured to receive shoulder 112 or 212 of insulation. Cable end 368 of mounting portion may include a concentric groove 370 around interior opening 372 sized to receive insulation shoulder 112, 212. In addition, because insulation may include one or more nipples 114, 214 around perimeter of its shoulder, there may be one or more indentations 374 spaced around perimeter of groove 370 configured to receive nipples 114, 214.

Previous receptacles located indentations circumferentially midway between fastener openings, at the locations where wall between interior and exterior surfaces is the smallest. In order to account for thinned walls, these receptacles included bulges on the exterior surface in order to increase the wall thickness. The current indentation orientation eliminates this situation by disposing indentations 374 between fastener openings 376 and thinnest portions 378 of wall, e.g., about every 22½ degrees from each, such that indentations are about 45 degrees apart, as seen in FIG. 28. There may be a plurality of indentations 374, e.g., at least about four indentations, to provide a user with freedom in positioning insulation so as to avoid putting rotational strain on insulation, contact, and/or cable. This orientation may simplify manufacture and require a smaller piece of material from which to form receptacle 350, reducing cost and manufacture time.

Turning now to FIGS. 32-37, another embodiment of a receptacle 400 is shown. Receptacle 400 may be particularly well-suited to in-line type cable connections, where ends of both cables being joined may be freely movable, i.e., neither cable is mounted at a wall, bulkhead, etc. In other words, receptacle 400 may be well-suited to connecting contacts 20, 70 retained within insulations 140, 240.

Figure 36:
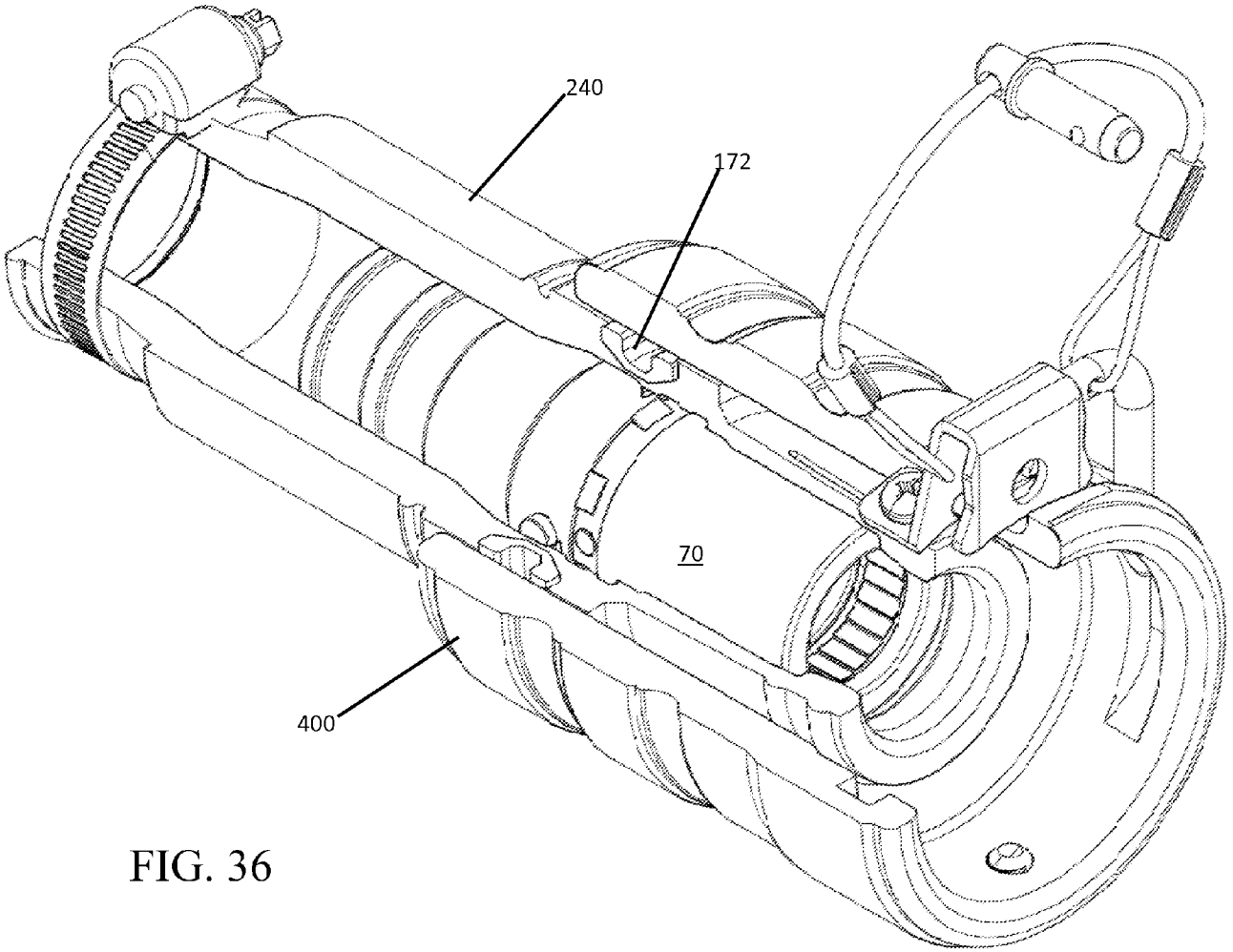
FIG. 36 is a partial cutaway, perspective view of the receptacle of FIG. 32 housing a female contact and its insulation.
Figure 37:
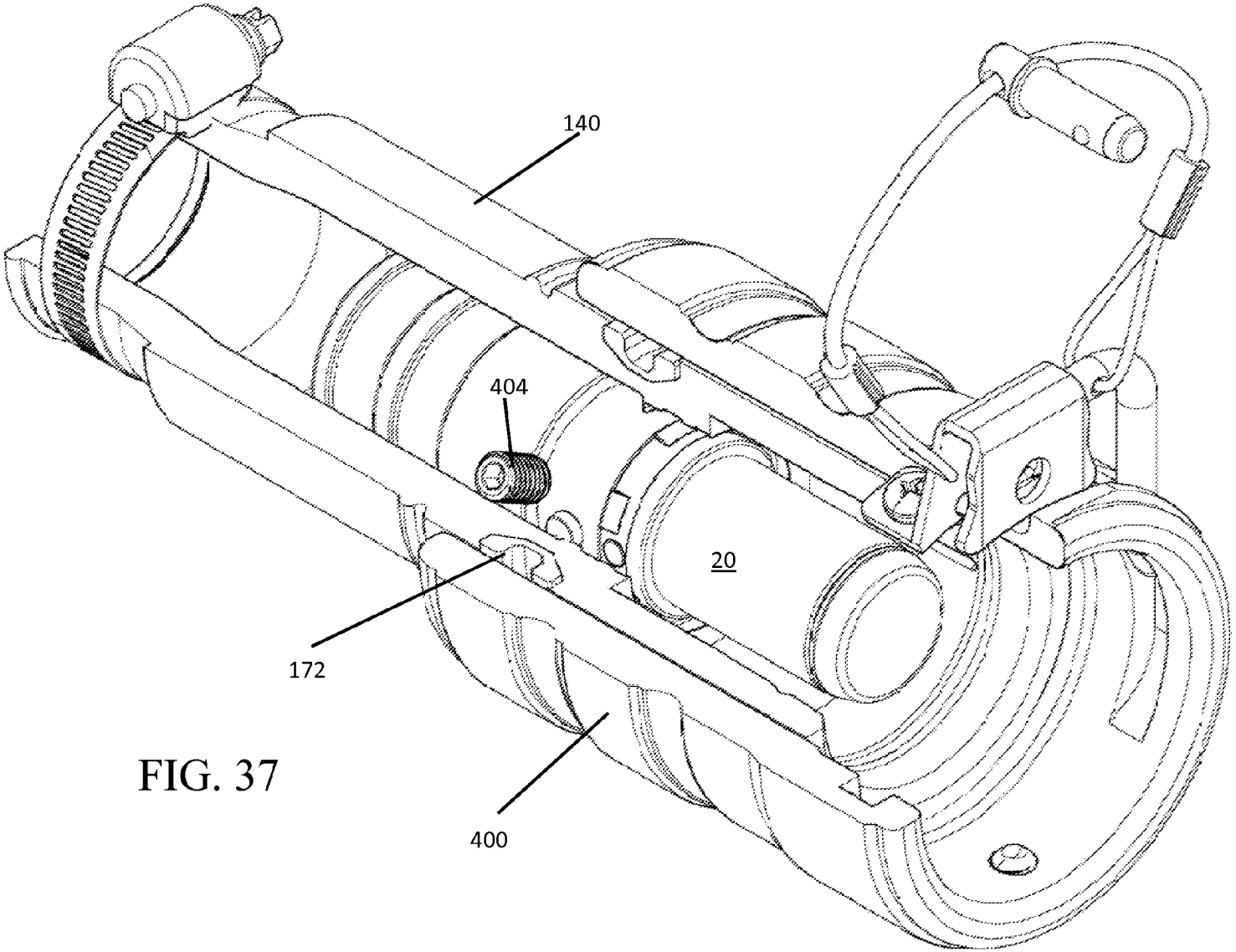
FIG. 37 is a partial cutaway, perspective view of the receptacle of FIG. 32 housing a male contact and its insulation.

First end 402 of receptacle 400 may be substantially similar to cable end 310 of receptacle 300 described above, i.e., it may include one or more locking mechanisms 404 such as set screws configured to be disposed in external channel 172 of insulation, as best seen in the assemblies of FIGS. 36-37. Similarly, second end 406 may be substantially similar to contact ends 312, 354 of receptacles 300, 350, including thickened wall portion 408, interior surface shoulder 410, and one or more types of locking mechanisms 412, 414. Dimensions of receptacles also may be similar, such that receptacles may be configured to receive each of the different types of insulations described above.

Unlike those other receptacles, receptacle 400 may not include a mounting portion but instead may be generally uniform in cross-section along its exterior surface 416, although exterior surface may include knurling 418 and circumferential grooves 420, e.g., in a staggered arrangement, which may improve grip when grabbing receptacle and attempting to join cables. Knurling 418 and grooves 420 may be formed around first end 402, in order to provide maximum area to grip receptacle 400 when attempting to engage and disengage hasp locking mechanism 412.

Figure 39:
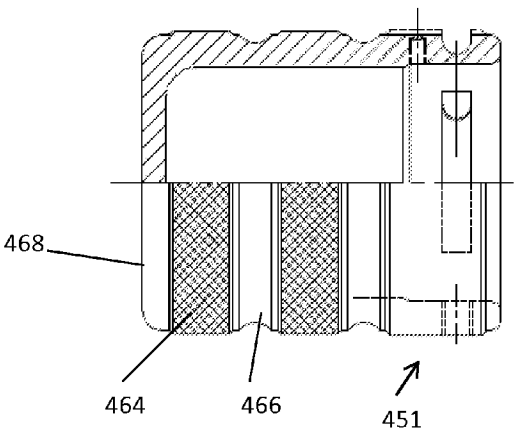
FIG. 39 is a side, partial section view of the receptacle of FIG. 38.
Figure 40:
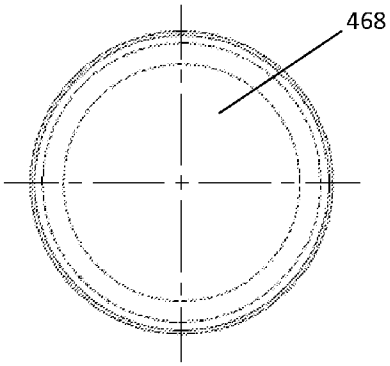
FIG. 40 is a rear view of the receptacle of FIG. 38.
Figure 38:
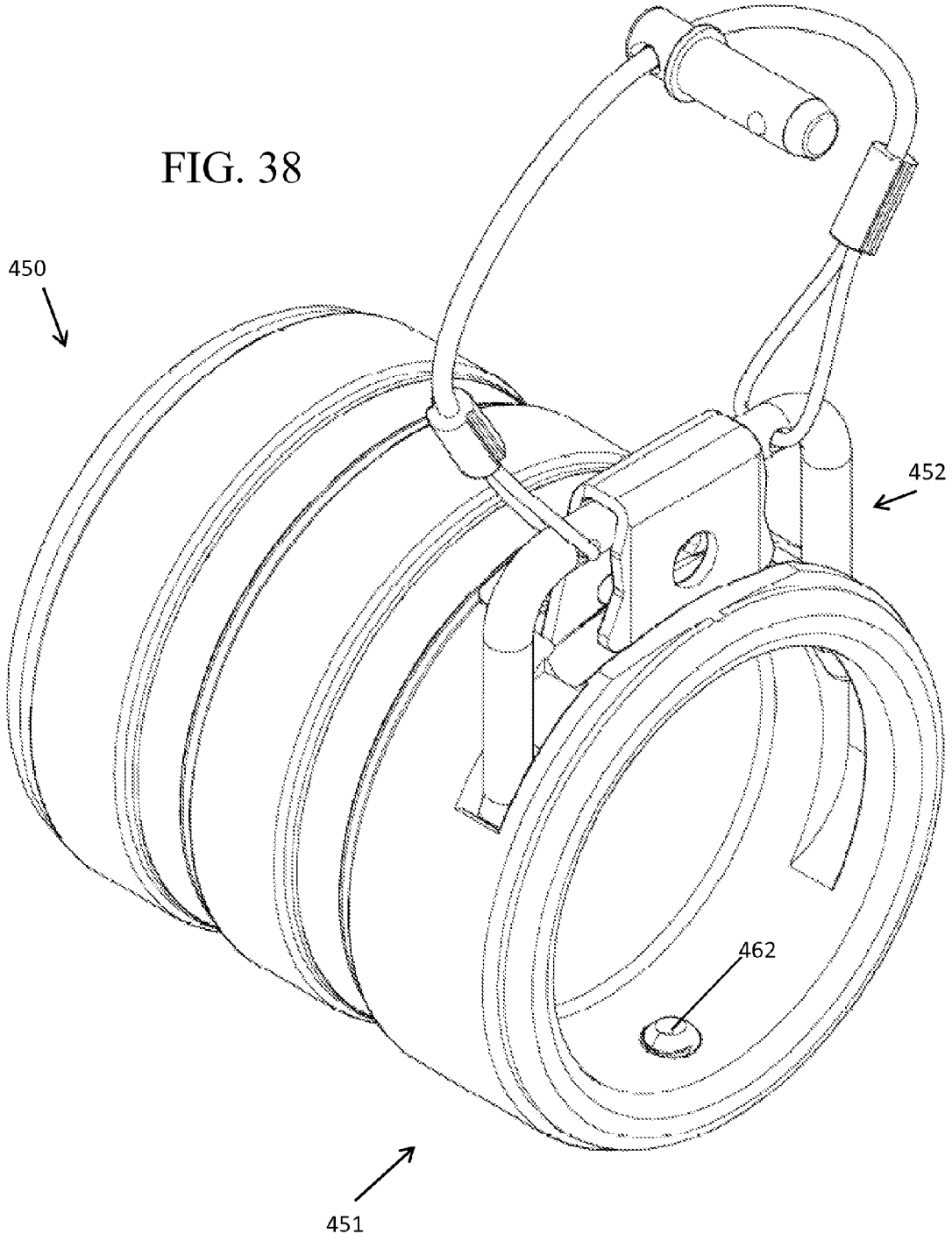
FIG. 38 is a perspective view of a fourth receptacle for securing a contact and its insulation.

Turning now to FIGS. 38-43, a further embodiment of a receptacle 450 is shown. As can be seen in FIGS. 38-39, a second end 451 of receptacle may be similar to the receptacles described above, including the locking mechanisms 452, 462 configured to hold receptacle 450 in place over insulation.

Figure 42:
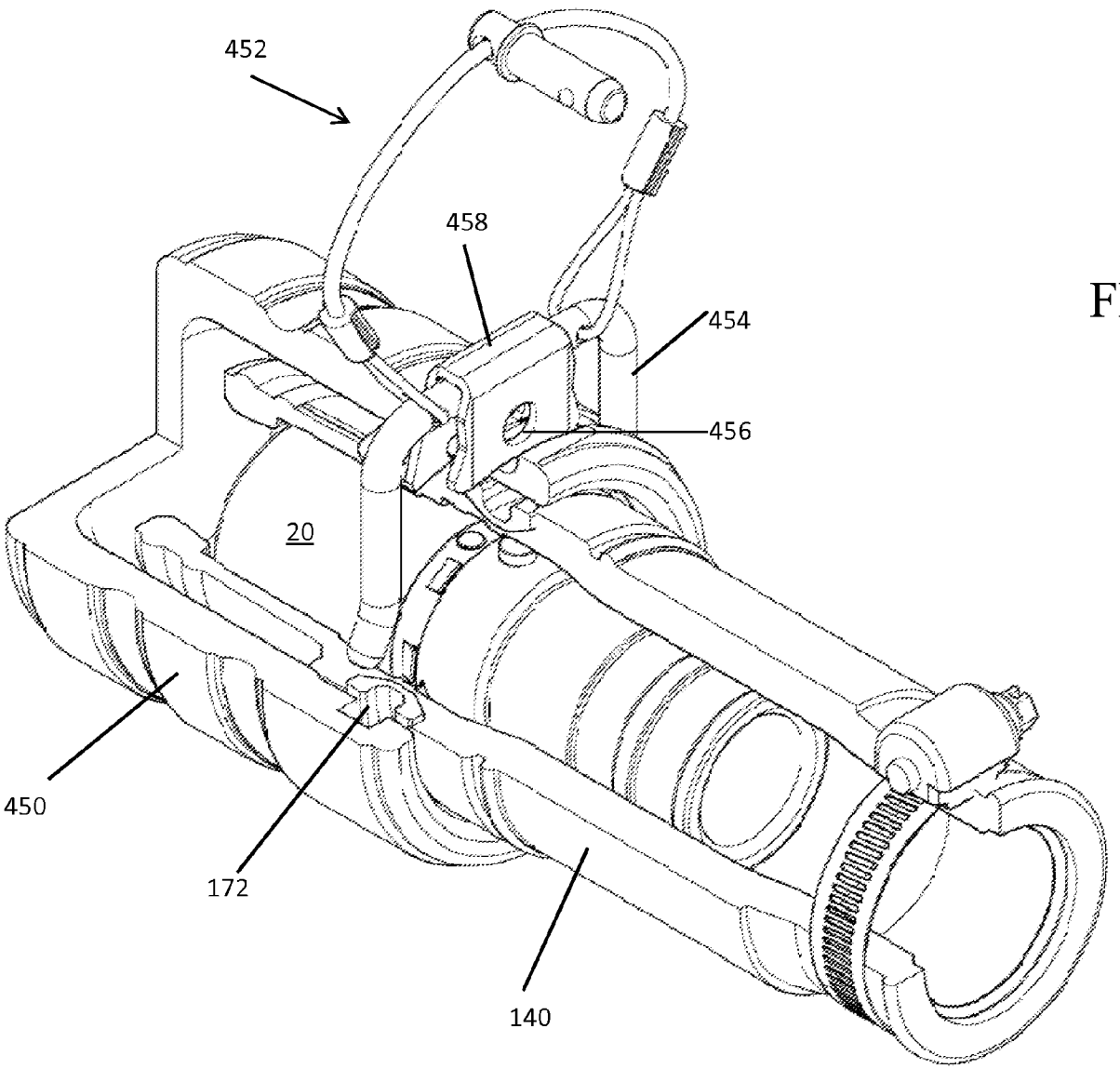
FIG. 42 is a partial cutaway, perspective view of the receptacle of FIG. 38 housing a female contact and its insulation.
Figure 43:
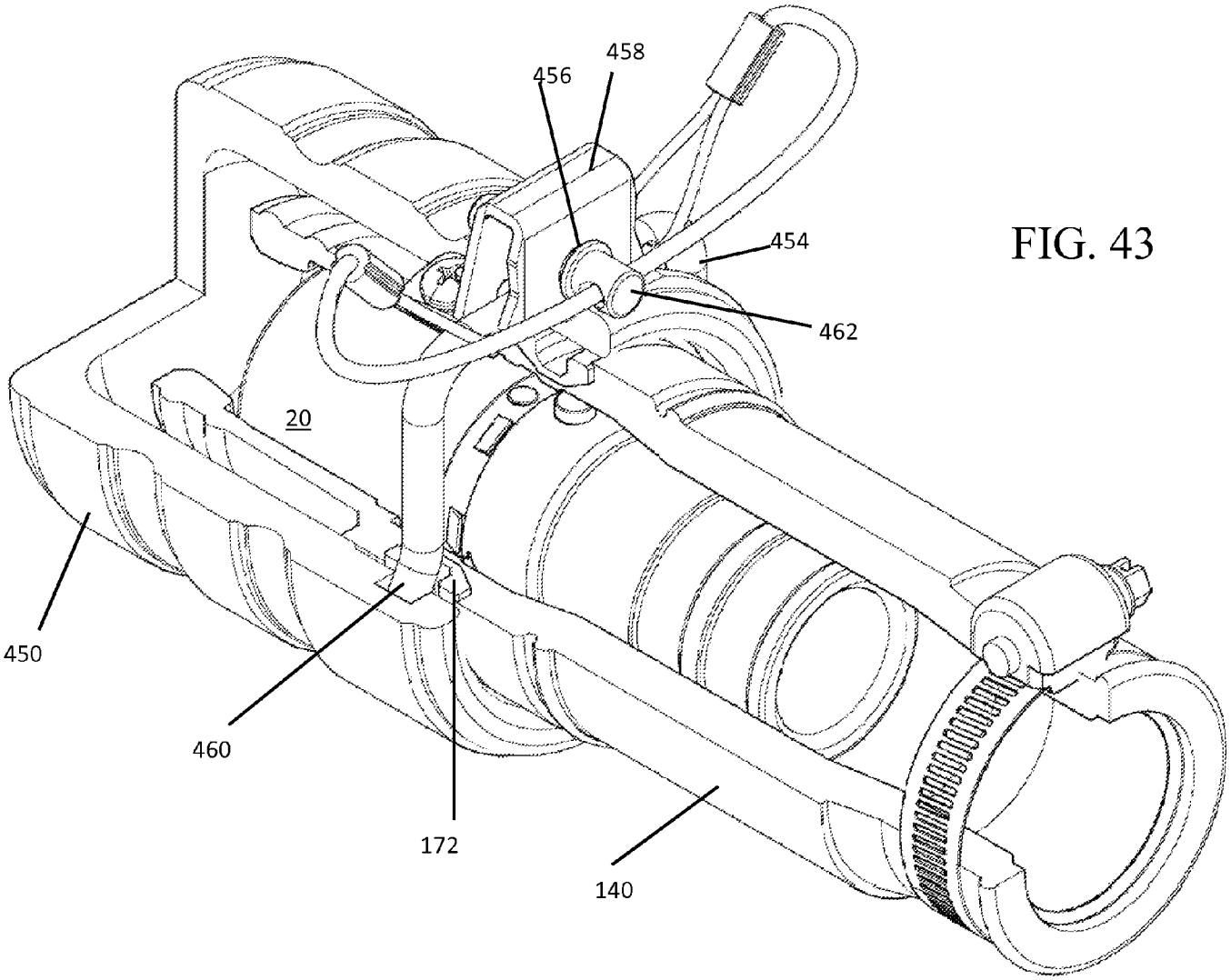
FIG. 43 is a partial cutaway, perspective view of the receptacle of FIG. 38 housing a male contact and its insulation.

This receptacle 450 may be used as a cover to go over the end of an insulation when not in use, as seen in the assemblies of FIGS. 42-43.

FIG. 42 illustrates a configuration where locking mechanism 452 is not engaged, i.e., hasp 454 is raised above openings 456 on mounting bracket 458 such that ends 460 of hasp are not disposed within internal groove 172 of insulation. In this configuration, insulation 140 and contact 20 may move laterally freely in and out of receptacle 450.

Conversely, FIG. 43 illustrates a configuration where locking mechanism 454 is engaged, i.e., hasp 454 is depressed below openings 456 and pin 462 is inserted into openings. Ends 460 of hasp now are disposed within groove 172 of insulation, preventing lateral movement of insulation 140 and contact 20 relative to receptacle 450.

Like the previously described in-line receptacle 400, this receptacle also may include exterior knurling 464 and indentations 466 proximate first end to facilitate gripping of receptacle.

In contrast to other receptacles, receptacle 450 may include a closed first end 468, such that interior surface 470 does not extend throughout the entire length of the receptacle.

To assemble and use connectors, a male contact electrically coupled to a cable may be located within a corresponding "male" insulation. Similarly, a female contact electrically coupled to a different cable may be located within a corresponding "female" insulation. There may be an air gap between contact ends of male contact and male insulation. Conversely, there may be minimal or no air gap between contact ends of female contact and female insulation. Additionally, air gap between male contact and its insulation may be sufficient to accommodate female contact and its insulation. As such, coupling of contacts may include inserting contact end of male contact into contact end of female insulation while also inserting contact end of female insulation into contact end of male insulation. In this way, the total cross-sectional area of contacts and insulations is reduced, allowing them to fit within smaller receptacle openings.

Prior to coupling contacts together, one contact and its insulation may be secured within a receptacle, e.g., at a bulkhead, through a wall, or at a freestanding location. The other contact and its receptacle then may be inserted into an opposite end of the receptacle, thereby joining the contacts as described above. The second contact and insulation also may be locked into place inside the receptacle, thereby facilitating a secure electrical connection between contacts.

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment and method, but by all embodiments and methods within the scope and spirit of the invention as claimed.

I claim:

1. An electrical connector system comprising:

a contact having a first end configured to electrically couple to a cable and a second end configured to electrically couple to another contact; and an insulation configured to completely surround at least the second end of the contact;

wherein the contact is a male contact rated at at least 1000V;

and further wherein the insulation is spaced radially from a perimeter of the second end a distance sufficient to accommodate a female contact and an insulation surrounding the female contact radially inwardly of the insulation surrounding the male contact.

2. The electrical connector system of claim 1, wherein the insulation is rubber.

3. The electrical connector system of claim 1, wherein the second end is spaced axially inward from a connector end of the insulation.

4. The electrical connector system of claim 1, wherein the contact includes a plurality of wings extending radially outward when progressing toward the first end.

5. The electrical connector system of claim 4, the plurality of wings beginning their radial extension at a first radial distance;

wherein a female contact configured to electrically couple to the male contact includes a second plurality of wings beginning a radial extension at a second radial distance;

wherein the first radial distance is different than the second radial distance.

6. The electrical connector system of claim 4, wherein the wings are disposed on a clip extending circumferentially about at least a portion of the contact.

7. The electrical connector system of claim 6, wherein an operative portion of the insulation axially aligned with the wings has an internal opening, the internal opening having a radius smaller than a largest radial extent of the wings.

8. The electrical connector system of claim 1, the insulation having an internal opening including a plurality of circumferentially arranged depressions;

the contact including a plurality of radially outwardly extending protrusions;

wherein the protrusions are configured to engage within the depressions.

9. The electrical connector system of claim 8, wherein the plurality of circumferentially arranged depressions comprises twelve depressions.

10. The electrical connector system of claim 1, further comprising:

a female contact having a first end configured to electrically couple to a cable and a second end configured to electrically couple to the male contact; and a second insulation configured to completely surround at least the second end of the female contact;

wherein an external diameter of the second insulation proximate the second end of the female contact is smaller than an internal diameter of the insulation proximate the second end of the male contact.

11. The electrical connector system of claim 1, further comprising:

a receptacle releasably couplable to the insulation;

wherein the second end of the contact is configured to be disposed within receptacle.

12. An electrical connector system comprising:

a contact having a first end configured to electrically couple to a cable and a second end configured to electrically couple to another contact; and an insulation configured to completely surround at least the second end of the contact;

wherein the contact is a female contact;

and further wherein the insulation circumferentially abuts a perimeter of the second end.

13. The electrical connector system of claim 12, wherein the insulation is rubber.

14. The electrical connector system of claim 12, wherein the second end is spaced axially inward from a connector end of the insulation.

15. The electrical connector system of claim 12, wherein the insulation has an interior opening including a substantially axially-extending portion transitioning into a tapered wall portion, wherein the tapered wall portion forms a shoulder against which the second end of the contact is disposed.

16. The electrical connector system of claim 12, further comprising:

a male contact having a first end configured to electrically couple to a cable and a second end configured to electrically couple to the female contact; and a second insulation configured to completely surround at least the second end of the male contact, the second end of the female contact, and an end of the insulation surrounding the female contact.

17. A receptacle for securing an end of at least one electrical contact and insulation, comprising:

an entrance into an interior opening at one end of the receptacle; and a sidewall surrounding the interior opening;

wherein the sidewall has a cross-section generally equal to an outer cross-section of a rubber insulation surrounding a male contact;

wherein the male contact is rated at at least 1000V.

18. The receptacle of claim 17, wherein the receptacle is metallic.

19. The receptacle of claim 17, wherein the receptacle includes a flange spaced from an end of the receptacle, the flange including a plurality of openings configured to receive a plurality of fasteners; and further wherein the openings are spaced about 2½" apart.

20. The receptacle of claim 19, wherein the flange is disposed between the end and a second end of the receptacle.

21. The receptacle of claim 19, wherein the flange is disposed at a second end of the receptacle.

22. The receptacle of claim 21, the flange including a recess configured to receive a shoulder of an insulation.

23. The receptacle of claim 22, wherein the recess includes a plurality of indentations circumferentially spaced about the recess, the indentations offset from the plurality of openings by about 22½ degrees.

24. The receptacle of claim 17, further comprising a locking mechanism proximate the one end.

25. The receptacle of claim 22, wherein the locking mechanism is manually engageable and releasable.

26. The receptacle of claim 22, wherein the locking mechanism requires a tool for engagement and disengagement.

27. The receptacle of claim 17, wherein the interior opening does not extend completely along an axial length of the receptacle.

28. An electrical connector system comprising:

a contact having a cable end and a contact end;

an insulation completely surrounding the contact end; and a receptacle configured to completely surround the insulation and contact proximate the contact end;

wherein, if the contact is a male contact, the insulation is spaced radially from a perimeter of the contact end a distance sufficient to accommodate a female contact and an insulation surrounding the female contact radially inwardly of the insulation surrounding the male contact; and wherein, if the contact is a female contact, the insulation circumferentially abuts a perimeter of the contact end.

29. The electrical connector system of claim 28, further comprising:

a second contact and a second insulation;

wherein one of the contact and the second contact is a male contact; and wherein the other of the contact and the second contact is a female contact.

30. The electrical connector system of claim 28, wherein the receptacle is configured to couple to a bulkhead.

31. The electrical connector system of claim 28, wherein the receptacle is configured to mount to a wall.

32. The electrical connector system of claim 28, wherein the receptacle is configured to allow relocation of the contact and the insulation after coupling with the receptacle.

33. An insulation for an electrical connector system, comprising:

a cable end having an opening configured to receive a contact having a tip, the contact rated at at least 1000V;

a contact end having a second opening and an entrance to the second opening;

an internal channel extending between the opening and second opening;

wherein the insulation is configured to position the tip axially internally of the entrance; and retention means for keeping at least one of a contact and a receptacle in a predetermined position relative to the insulation;

wherein the insulation is rubber;

wherein, if the contact is a male contact, the contact end is configured to provide a radial gap between the tip and an inner wall of the insulation sufficient to receive a female contact and an insulation surrounding the female contact; and wherein, if the contact is a female contact, the contact end is configured to provide no radial gap between the tip and an inner wall of the insulation.

34. The insulation of claim 33, wherein the retention means comprise a plurality of indentations formed circumferentially within an intermediate portion of the internal channel, the indentations configured to interface with a plurality of protrusions extending radially outwardly from a contact.

35. The insulation of claim 33, wherein the retention means comprise a diameter of the internal channel configured to press fit against a retention clip disposed around a contact.

36. The insulation of claim 33, wherein the retention means comprise a friction fit with an intermediate portion spaced between cable end and contact end.

37. The insulation of claim 33, wherein the retention means comprise an exterior channel configured to receive one or more set screws operatively coupled to a receptacle.

38. The insulation of claim 33, wherein the retention means comprise one or more nipples extending outward from a flange, the nipples configured to be disposed circumferentially around a receptacle.

* * * * *